US008534033B2

(12) United States Patent
Perreault et al.

(10) Patent No.: US 8,534,033 B2
(45) Date of Patent: Sep. 17, 2013

(54) APPARATUS FOR WRAPPING AN ARTICLE AND METHOD FOR DOING SAME

(75) Inventors: Martin Perreault, Quebec (CA); Nicolas Tremblay, Quebec (CA)

(73) Assignee: 9192-9281 Quebec Inc., Quebec (CA)

( * ) Notice: Subject to any disclaimer, the term of this patent is extended or adjusted under 35 U.S.C. 154(b) by 318 days.

(21) Appl. No.: 12/919,144

(22) PCT Filed: Feb. 27, 2009

(86) PCT No.: PCT/CA2009/000225
§ 371 (c)(1),
(2), (4) Date: Aug. 24, 2010

(87) PCT Pub. No.: WO2009/105879
PCT Pub. Date: Sep. 3, 2009

(65) Prior Publication Data

US 2010/0326018 A1 Dec. 30, 2010

Related U.S. Application Data

(60) Provisional application No. 61/032,485, filed on Feb. 29, 2008.

(51) Int. Cl.
*B65B 11/00* (2006.01)

(52) U.S. Cl.
USPC ..... 53/460; 53/397

(58) Field of Classification Search
USPC ..... 53/397, 580, 461, 465, 203, 210, 53/209, 230
See application file for complete search history.

(56) References Cited

U.S. PATENT DOCUMENTS

| | | | | |
|---|---|---|---|---|
| 2,858,657 | A * | 11/1958 | Guthrie | 53/218 |
| 3,238,697 | A * | 3/1966 | Zucker | 53/230 |
| 3,327,452 | A * | 6/1967 | Cranston, Jr. et al. | 53/218 |
| 3,338,025 | A * | 8/1967 | Harrison et al. | 53/230 |
| 3,507,091 | A * | 4/1970 | Gillespie et al. | 53/131.2 |
| 3,553,935 | A * | 1/1971 | Woods | 53/209 |

(Continued)

FOREIGN PATENT DOCUMENTS

| | | |
|---|---|---|
| CA | 2 541 029 A1 | 9/2006 |
| WO | 03024805 | 3/2003 |

OTHER PUBLICATIONS

Bead-Media.com, Wrap a Package, Aug. 26, 2006, www.bead-media.com/wrapapackage.html.*

*Primary Examiner* — Alexandra Elve
*Assistant Examiner* — Andrew M Tecco
(74) *Attorney, Agent, or Firm* — Sutherland Asbill & Brennan LLP

(57) ABSTRACT

A method for wrapping at least a portion of an article (22) including folding the wrapper material (60) to cover at least one first peripheral face (24, 30) such that each one of at least two first wrapper sections extends beyond a respective first lateral edge (32) of the at least one first peripheral face (24, 30) and such that each one of at least one second wrapper section extends beyond an upper edge (38, 40) of a respective one of at least one second peripheral face (30, 24), folding and securing each first section against one of the at least one second peripheral face (30, 24), and folding and securing each second section against the respective second peripheral face (30, 24). The wrapper material (60) remaining at least partially grabbed until at least one of the at least one second section is secured.

13 Claims, 24 Drawing Sheets

(56) References Cited

U.S. PATENT DOCUMENTS

| | | | | | |
|---|---|---|---|---|---|
| 3,707,064 | A | | 12/1972 | Mucka et al. | |
| 3,771,280 | A | * | 11/1973 | Bechle | 53/461 |
| 3,775,930 | A | * | 12/1973 | Mercer et al. | 53/461 |
| 3,792,563 | A | * | 2/1974 | Mercer et al. | 53/461 |
| 3,808,767 | A | * | 5/1974 | Reid | 53/442 |
| 4,231,210 | A | * | 11/1980 | Nagode | 53/397 |
| 5,657,608 | A | | 8/1997 | Parviainen et al. | |
| 6,026,957 | A | * | 2/2000 | Bauer et al. | 206/494 |
| 6,279,295 | B1 | * | 8/2001 | Girard et al. | 53/397 |
| 6,460,314 | B1 | * | 10/2002 | Girard et al. | 53/389.3 |
| 7,082,740 | B2 | | 8/2006 | van der Lely | |
| 2002/0053183 | A1 | | 5/2002 | Yuyama et al. | |
| 2006/0096244 | A1 | | 5/2006 | Cere' | |

* cited by examiner

APPARATUS FOR WRAPPING AN ARTICLE AND METHOD FOR DOING SAME

CROSS-REFERENCE TO RELATED APPLICATION

This application claims priority on U.S. provisional application No. 61/032,485 filed Feb. 29, 2008, which is incorporated herein by reference in its entirety. This application is a national phase of PCT application PCT/CA2009/000225, filed Feb. 27, 2009, designating the United States, now pending, the specification of which is hereby incorporated by reference.

FIELD OF THE INVENTION

The invention relates to an apparatus for wrapping an article such as a parallelepiped shaped bundle, and to a method of wrapping such an article.

BACKGROUND ART

It is known to wrap or envelop articles having an essentially orthogonal form, such as bundles of lumber, pulp, plywood or chipboard, or a pile of any adequate type of articles, on five sides thereof by suitable wrapper material. This can be done to protect the articles, for instance to provide protection during transportation and storage, or to provide a solid surface for various markings such as for example, identifiers, labels and/or commercial advertisements. In some instances, the wrapper material is used to give the articles a neater appearance, and/or to hide some details thereof which are not intended to be seen by the public.

Placement and folding of the wrapper sheet is usually a manual or semi-automatic operation, whereby a wrapper material Web is supplied from a material roll positioned above the article to be wrapped. The article is placed on a conveyor, and the wrapper is drawn from the roll over the article as the article passes by the roll. When the rear end of the article has passed the material roll, the material web is manually or automatically cut. The wrapper material is then folded around the article. The attachment of the wrapper foldings or tongues may be effected by gluing, taping, riveting, stapling, etc.

Known methods of wrapping an article include the use of rollers to apply wrapping material to the faces of the article, and/or blowers to position the wrapper material and optionally heat shrink it in place. However, if the wrapper material is not correctly positioned prior to engagement with the rollers and/or jets from the blowers, the resulting aspect of the wrapped product may be irregular, which is undesirable.

SUMMARY

It is therefore an aim of the present invention to provide an improved wrapping apparatus and method.

Therefore, in accordance with the present invention, there is provided a method for wrapping at least a portion of an article having a substantially parallelepiped shape or a parallelepiped shape with a wrapper material, the method comprising grabbing the wrapper material along at least one first wrapper edge of the wrapper material, proximate to a first end of the wrapper material, extending the wrapper material over at least part of an upper face of the article, folding the wrapper material to cover at least one first peripheral face of the article with the wrapper material, such that each one of at least two first sections of the wrapper material extends beyond a respective first lateral edge of the at least one first peripheral face and such that each one of at least one second section of the wrapper material, extends beyond an upper edge of a respective one of at least one second peripheral face adjacent the at least one first peripheral face, folding each first section about the respective first lateral edge and against one of the at least one second peripheral face, securing each folded first section to the one of the at least one second peripheral face, folding each second section about the upper edge of the respective second peripheral face and against the respective second peripheral face, and securing each folded second section to the respective second peripheral face, wherein the wrapper material remains at least partially grabbed until at least one of the at least one second section is secured.

Also in accordance with the present invention, there is provided an apparatus for wrapping a substantially parallelepiped shaped or parallelepiped shaped article with a wrapper material web, the apparatus comprising a wrapper material supply unit, a wrapper holder having two spaced-apart wrapper gripping units, each of the two wrapper gripping unit being mounted on a respective side of the wrapper material supply unit for gripping an edge of the wrapper material web, each gripping unit being movable along at least a vertical direction and a transverse direction of the apparatus, a wrapper material fastening unit for securing the wrapper material to the article, at least one actuator operatively connected to the at least two gripping units and displacing the wrapper holder when activated, and at least one controller operatively connected to the at least one actuator, to the at least two wrapper gripping units for controlling the gripping unit displacement, and to the wrapper material fastening unit, the controller being in communication with the wrapper gripping units and the wrapper material fastening unit for preventing the wrapper gripping units from completely releasing the wrapper material until the wrapper material is secured to the article.

Also in accordance with the present invention, there is provided a wrapping apparatus for wrapping an article with a wrapper material web, the apparatus comprising a wrapping station for receiving the article to be wrapped, a wrapper material supply unit including a wrapper material web supply, a wrapper holder for gripping the wrapper material web and carrying the wrapper material web along a wrapper material path extending from the wrapper material supply unit to the wrapping station, and a wrapper material identifying unit mounted between the wrapper material supply unit and the wrapping station along the wrapper material path for adding printed information to the wrapper material prior to article wrapping.

Also in accordance with the present invention, there is provided a method for adding printed information on a wrapper material for an article, comprising drawing the wrapper material from a wrapper material roll, adding the printed information on the drawn wrapper material, and wrapping at least a section of the article with the wrapper material including the printed information.

Further in accordance with the present invention, there is provided a method for adding printed information on a wrapper material for an article, comprising determining an information position on the article, determining a printing position for the printed information on the wrapper material in accordance with a size of the article, a wrapping method used, and the information position, drawing the wrapper material from a wrapper material roll, adding the printed information on the wrapper material at the printed position; and wrapping at least a section of the article with the wrapper material including the printed information, the printed information being located at the information position on the wrapped article.

BRIEF DESCRIPTION OF THE DRAWINGS

Reference will now be made to the accompanying drawings, showing by way of illustration a particular embodiment of the present invention and in which.

It will be noted that throughout the appended drawings, like features are identified by like reference numerals.

DETAILED DESCRIPTION OF PARTICULAR EMBODIMENTS

Figure 1:
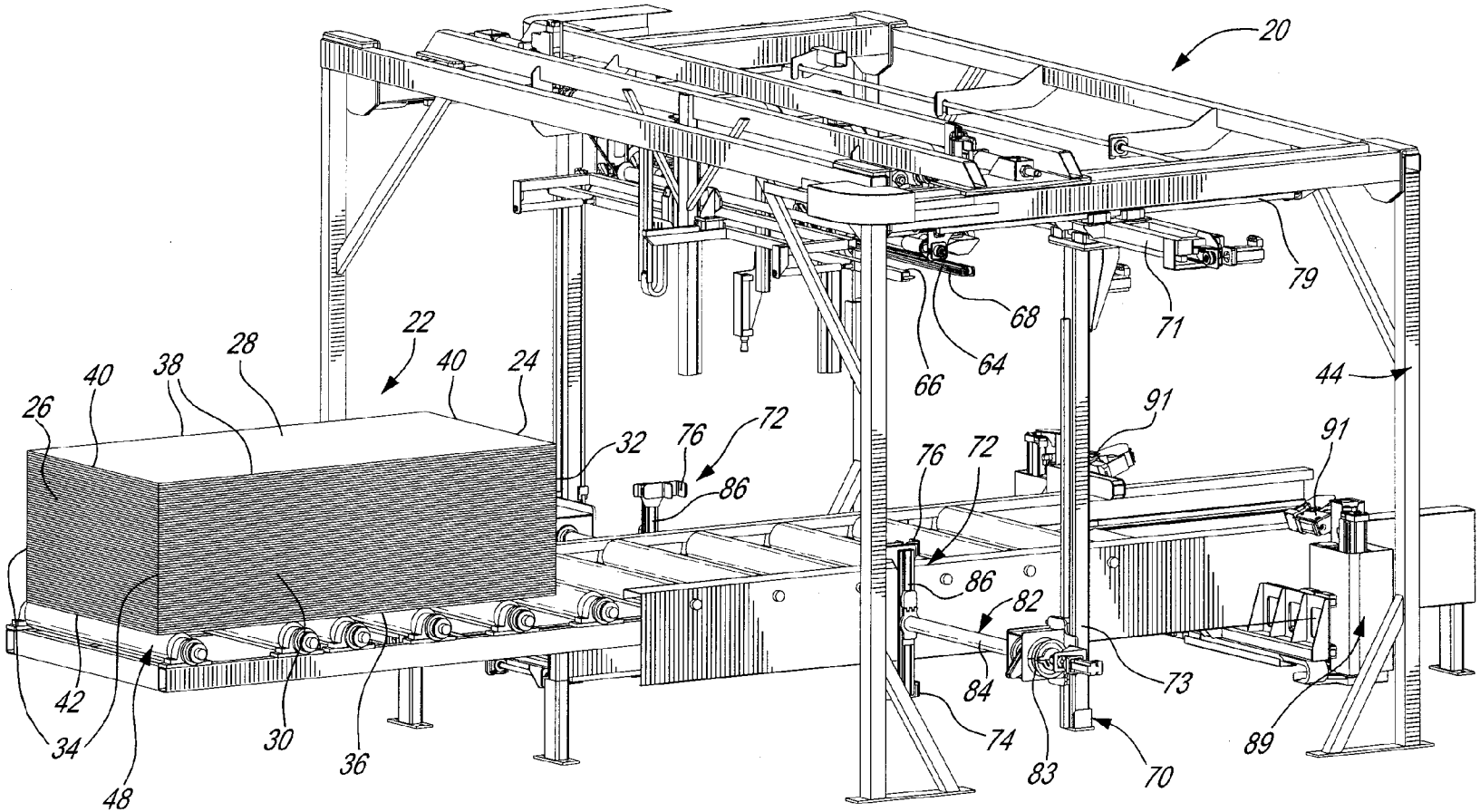
FIG. 1 is a perspective view of a wrapping apparatus according to a particular embodiment of the present invention.

Referring now to the drawings and, more particularly, referring to FIG. 1, there is shown a wrapping apparatus 20 in accordance with a particular embodiment of the present invention. The wrapping apparatus 20 is designed for wrapping an article, more particularly a parallelepiped shaped or substantially parallelepiped shaped article 22 such as, without being limitative, a bundle of lumber, plywood or chipboard or a pile of other articles, for instance, articles used in construction work, or a paper or pulp bale or any other adequate type of article.

The generally shaped parallelepiped article 22 has an upper face 28 and an opposed lower face (now shown), which are interconnected by four (4) peripheral faces. The peripheral faces includes a front (first) end face 24, a rear (second) end face 26 opposed to the front end face 24, and two opposed lateral faces 30 extending between the front and the rear end faces 24, 26. The front end face 24 and the lateral faces 30 meet at front lateral edges 32. Similarly, the rear end face 26 and the lateral faces 30 meet at rear lateral edges 34. The lateral faces 30 each extend between a lower longitudinal edge 36 and an upper longitudinal edge 38. Each of the front and the rear end faces 24, 26 meets with the upper face 28 at an upper transversal edge 40 and meets with the lower face at a lower transversal edge 42.

Figure 2:
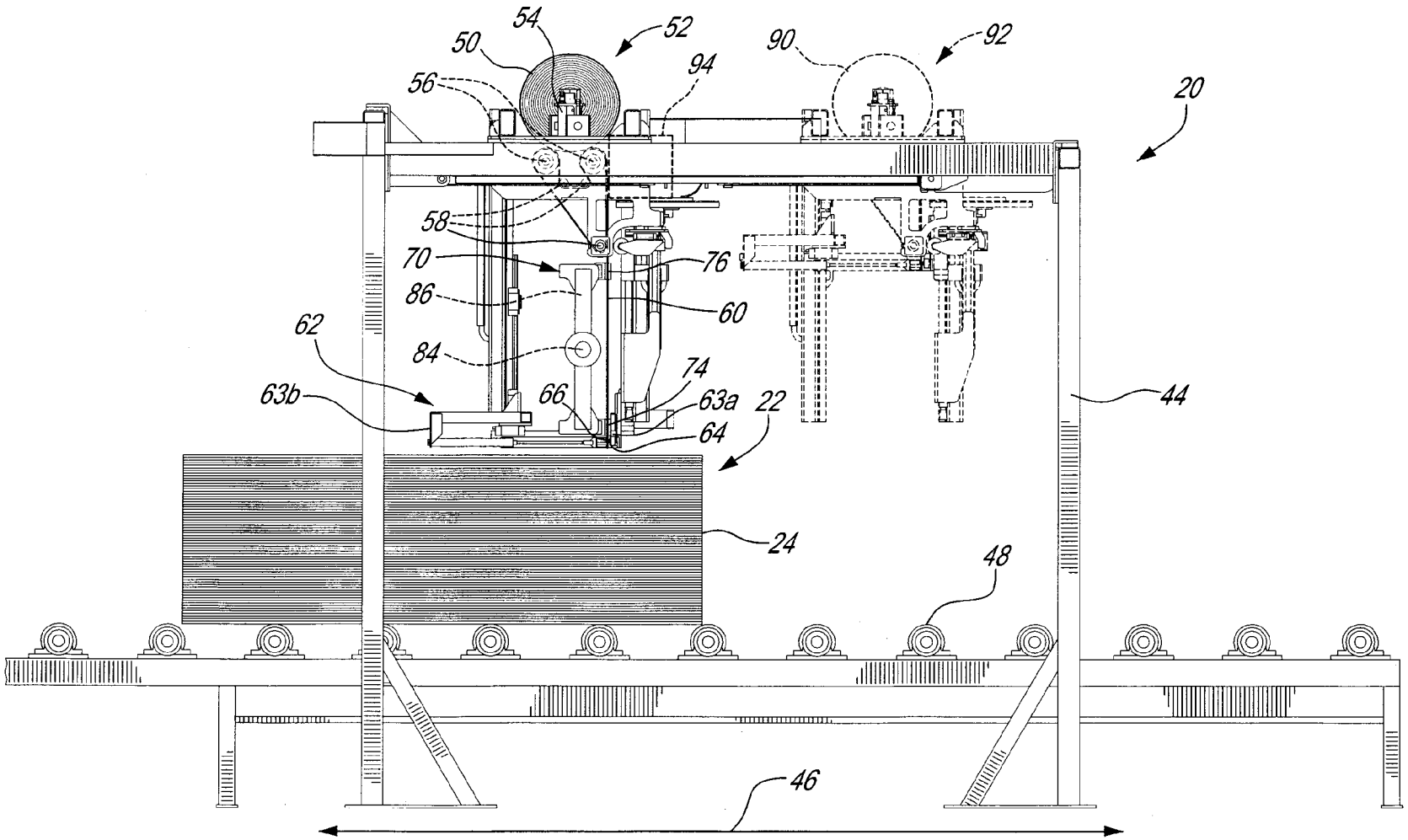
FIG. 2 is a side elevation view of the wrapping apparatus of FIG. 1, showing a wrapping step where an article to be wrapped is moved to a wrapping station.

The wrapping apparatus 20 has a wrapping station frame 44 defining a longitudinal direction 46 (see FIG. 2). A conveyor 48 extends along the longitudinal direction 46 below the wrapping station frame 44. In a particular embodiment, the conveyor 48 is omitted, and the article is placed under the wrapping station frame 44 through any adequate means, and remains in a fixed location during the wrapping process.

Referring to FIG. 2, the apparatus 20 includes a wrapper delivering unit 52 with a wrapper delivering unit frame 54 carrying a web material roll 50. The wrapper delivering unit frame 54 includes two supporting rolls 56 on which the web material roll 50 is rotatably mounted. The supporting rolls 56 can be motorized rolls to facilitate web delivery.

The web material roll 50 supplies wrapper material 60. The wrapper material 60 extends from the web material roll 50, around the supporting rolls 56 and around a plurality of guiding rolls 58, and to a wrapper dispenser 62.

The wrapper dispenser 62 can translate between a lower position (FIGS. 2 to 5) and a higher position (FIGS. 6 to 10). It includes a dispenser frame having a fixed arm 63*a* and a moveable arm 63*b*, which in the embodiment shown is slidable, but can alternately be pivotable. The fixed arm 63*a* carries a wrapper guiding member 64 while the moveable arm 63*b* carries a wrapper dispensing stopper 66, opposed to the guiding member 64. The fixed arm 63*a* can include a wrapper cutter 68 to cut the wrapper material web 60 at a predetermined length, which is adjusted in accordance with the article 22 being wrapped. In a particular embodiment, the wrapper cutter 68 includes a blade cutter. The wrapper cutter can include alternate cutting mechanisms, such as for example a heated wire.

It is appreciated that the embodiments described above for the wrapper dispenser 62 and the wrapper cutter 68 are exemplary only and several variations can be foreseen.

Thus, the wrapper dispenser 62 allows wrapper material dispensing when the wrapper dispenser 62 is in a dispensing configuration (for example in FIG. 3A) and prevents wrapper material dispensing when the wrapper dispenser 62 is a non-dispensing configuration (for example in FIG. 2). In the non-dispensing configuration, the wrapper dispensing stopper 66 abuts the guiding member 64, with the wrapper material 60 extending therebetween. On the opposite, in the wrapper material dispensing configuration, the wrapper dispensing stopper 66 slides away from the guiding member 64 to be spaced-apart therefrom.

The wrapper dispenser 62 can be operatively connected to a controller which controls for example the wrapper material dispensing timing and/or the quantity of wrapper material dispensed. Both variables can be adjusted in accordance with the length of the article being wrapped.

Referring back to FIG. 1, the wrapping apparatus also includes a wrapper holder 70 which includes two wrapper gripping units 72. Each wrapper gripping unit 72 is mounted on a respective side of the apparatus 20, i.e. on a respective side of the conveyor 48. Only one gripping unit 72 will be described below since both gripping units 72 are similar.

Each wrapper gripping unit 72 includes spaced apart first and second wrapper grippers 74, 76. Both wrapper grippers 74, 76 are designed to grab the wrapper material 60 proximate to a longitudinal edge thereof. In a particular embodiment, the distance between the wrapper grippers 74, 76 can be adjusted, either before the wrapping process or during the wrapping process as required, either manually or automatically.

Referring to FIG. 1, in the embodiment shown, the wrapper holder 70 includes a horizontally extending transverse frame member 71 slidably mounted on a top rail member 79 which extends from on a top portion of the wrapping station frame 44. As such, the transverse frame member 71 can be translated along the longitudinal direction 46 of the apparatus 20. The wrapper holder 70 also includes a vertical frame member 73 on each side of the conveyor 48, each vertical frame member 73 having a top end slidably mounted to the transverse frame member 71 such that the vertical frame member 73 can be translated along a transverse direction, i.e. toward and away from the conveyor 48. Each gripping unit 72 has a base member 83 slidably mounted to a respective one of the vertical frame members 73, such that the base member 83 can be translated along an at least substantially vertical axis. As such each wrapper gripper 72 can be moved relative to the article to be wrapped along longitudinal, transverse and vertical directions.

Each gripping unit 72 includes a rotatable arm 82 which is substantially T-shaped with a first arm section 84 having one end rotationally mounted to the base member 83 and an opposed end attached to a second arm section 86. The second arm section 86 extends perpendicularly to the first arm section 84 and has two opposed ends carrying a respective one of the wrapper grippers 74, 76. As mentioned above, in a particular embodiment, the second arm section 86 and wrapper grippers 74, 76 are configured so that the distance between the wrapper grippers 74, 76 can be varied.

Thus, the wrapper grippers 74, 76 are spaced apart. They can be oriented relative to one another along a substantially vertical plane, along a substantially horizontal plane, or along any other plane extending therebetween to manipulate the wrapper material 60.

In a particular embodiment, the wrapper grippers 74, 76 include clamps designed to clamp the wrapper material 60, proximate to the longitudinal edge.

The wrapper grippers 74, 76 can be controlled independently, i.e. the task or the position of each gripper is controlled independently to the task or the position of the other gripper, or simultaneously, i.e. each task or position of a gripper is associated with a predetermined task or position from the associated gripper.

It is appreciated that, in alternate embodiments (not shown), the gripping units 72 can include only one or more than two wrapper gripper(s).

It is appreciated that either the gripping unit 72 can be displaced along the apparatus 20 for carrying the various wrapping steps or that the article 22 can be displaced relatively to the gripping units 72. Moreover, in an alternate embodiment, the various steps can be carried out with a combination of griping unit displacement and article displacement.

In an embodiment, each wrapper gripping unit 72 is operatively connected to a servomotor (not shown) such as to be movable along the three perpendicular directions. Thus, the mechanical position (or other parameters) of the wrapper grippers 74, 76 is controlled with a device including an error-sensing feedback to correct the performance of the mechanism. It is also operatively connected to a controller and a sensor, as will be described in more details below.

Each wrapper gripping unit displacement is limited by a predetermined target which can be, for instance and without being limitative, the position of one or both of the wrapper grippers 74, 76, the measured distance of the displacement, the stress or pressure sensed by sensor(s) or load cells resulting from the stress within the wrapper material slightly stretched over the article, or the torque applied to the wrapper grippers 74, 76, for example as measured by the servomotors.

It is appreciated that, in an alternate embodiment, each wrapper gripping unit 72 can be connected to a pneumatic system instead of or in combination with the servomotor.

In the embodiment shown, the wrapping apparatus 20 also includes a wrapper material fastening unit 89 which is designed to secure the wrapper material 60 to the article 22. The fastening unit 89 includes a pair of movable stapling mechanisms 91, one mechanism 91 being provided on each side of the article 22 and mounted on a transverse member slidably retained on the wrapping station frame 44. In an alternate embodiment (not shown), the stapling mechanism 91 are slidably retained on rails fixed to the floor. The stapling mechanisms 91 each include a stapling head which is movable along the height or the article as well as towards and away from the article, in order to be able to staple the wrapper material to the article in any desired location. The wrapper material fastening unit 89 is preferably operatively connected to a controller for controlling the timing for the insertion and the position of the fasteners.

In an alternate embodiment (not shown), the wrapper material fastening unit can be integrated with the wrapper grippers 74, 76, for example by including an integrated stapling head with at least one of the wrapper grippers 74, 76. The fastening unit can also alternately be manually operated.

Referring to FIG. 2, the wrapping apparatus 20 can also include one or several spare wrapper material rolls 90 (only one is shown in FIG. 2), which are mounted on spare wrapper delivering units 92.

In the embodiment shown, the wrapping apparatus includes a wrapper material identifying unit 94 such as a printer or a labeling apparatus. In a particular embodiment, the wrapper material identifying unit 94 is a printer. The identifying unit 94 is mounted next to the web material roll and the wrapper dispenser 62 and has a printing head juxtaposed to one of the supporting rolls 56, such that the wrapper material 50 extends between the printing head and the supporting roll 56. Thus, the supporting roll 56 provides support for the printing step.

Thus, when the wrapper material 60 is drawn by the wrapper holder 70, the wrapper material printer 94 prints on the wrapper material to indicate printed information such as information regarding the article being wrapped or advertising information or any other desired information.

It is appreciated that the wrapper material identifying unit 94 can be mounted anywhere between the wrapper material supply unit and the wrapping station along the wrapper material path for adding printed information to the wrapper material 60 prior to article wrapping. In the embodiment shown, the printed information is added to the outer surface, i.e. the surface which faces outwardly on the wrapped article, of the wrapper material 60. However, in an alternate embodiment, printed information could be provided on the inner surface of the wrapper material 60. It is appreciated that printed information can be added to the wrapper material 60 simultaneously while the wrapper holder 70 draws the wrapper material 60 from the wrapper material roll 50. In an alternate embodiment, the wrapper holder 70 can temporarily stop drawing the wrapper material 60 from the roll 50 for adding printed information of the wrapper material 60 at a predetermined printed information position along the wrapper material 60. Once the printed information is added, the wrapper holder 70 can continue drawing the wrapper material 60 from the wrapper material roll 50.

The wrapper material identifying unit 94 and wrapper holder 70 can be operatively connected to a controller (not shown) which controls the identification of the wrapper material web. Thus the controller determines when the identification is provided on the wrapper material 60, based on the wrapper holder 70 drawing speed or position. If a specific position of the identification is required on the article, the controller also determined when and where the identification is provided on the wrapper material 60 also based on the desired position of the identification on the wrapped article and on the article dimensions.

When wrapping an article, the wrapper material 60 is first drawn from the wrapper material roll 50. Printed information is added by the wrapper material identifying unit 94 on the drawn wrapper material 60 and, following the addition of printed information on the drawn wrapper material, at least a section of the article is wrapped with the wrapper material including the printed information.

As mentioned above, in an embodiment, the surface of the wrapper material 60 which includes the printed information faces outwardly of the wrapped article. If the printed information added to the wrapper material 60 needs to be added at a predetermined position on the wrapper material, the method for adding printed information on the wrapper material 60 also includes a step where a printed information position is determined on the wrapper material 60 in accordance with the size of the article to be wrapped. The printed information is added to the drawn wrapper material at the predetermined identification position and at least a section of the article is wrapped with the wrapper material including the added printed information. The printed information added to the wrapper material is located at the printed information position on the wrapped article.

Now the various steps for wrapping an article 22 will be described in reference to the apparatus shown in the embodiment of FIG. 1, and in reference to FIGS. 2 to 11, where only a portion of the wrapper gripping units 72 is shown for improved clarity.

Referring to FIG. 2, the article 22 to be wrapped is moved along the conveyor 48 until it reaches the wrapping area. In the embodiment shown, the article 22 is placed under the wrapper dispenser 62, with the front end face 24 extending forwardly of the wrapper dispenser 62. The wrapper material 60 extending from the web material roll 50 is grabbed by the gripping units 72 in a first wrapper gripping configuration, where each wrapper gripping unit 72 grabs the wrapper material 60 proximate to a respective one of its longitudinal edges, with the first wrapper grippers 74 being located proximate to a respective corner of the wrapper material 60 and the second wrapper grippers 76 being spaced from the corresponding first wrapper gripper 74 along the respective longitudinal edge of the wrapper material 60. In the initial position, the wrapper grippers 74, 76 of each wrapper gripping unit 72 are vertically aligned with one another with the first wrapper gripper 74 being located under the second wrapper gripper.

Figure 3A:
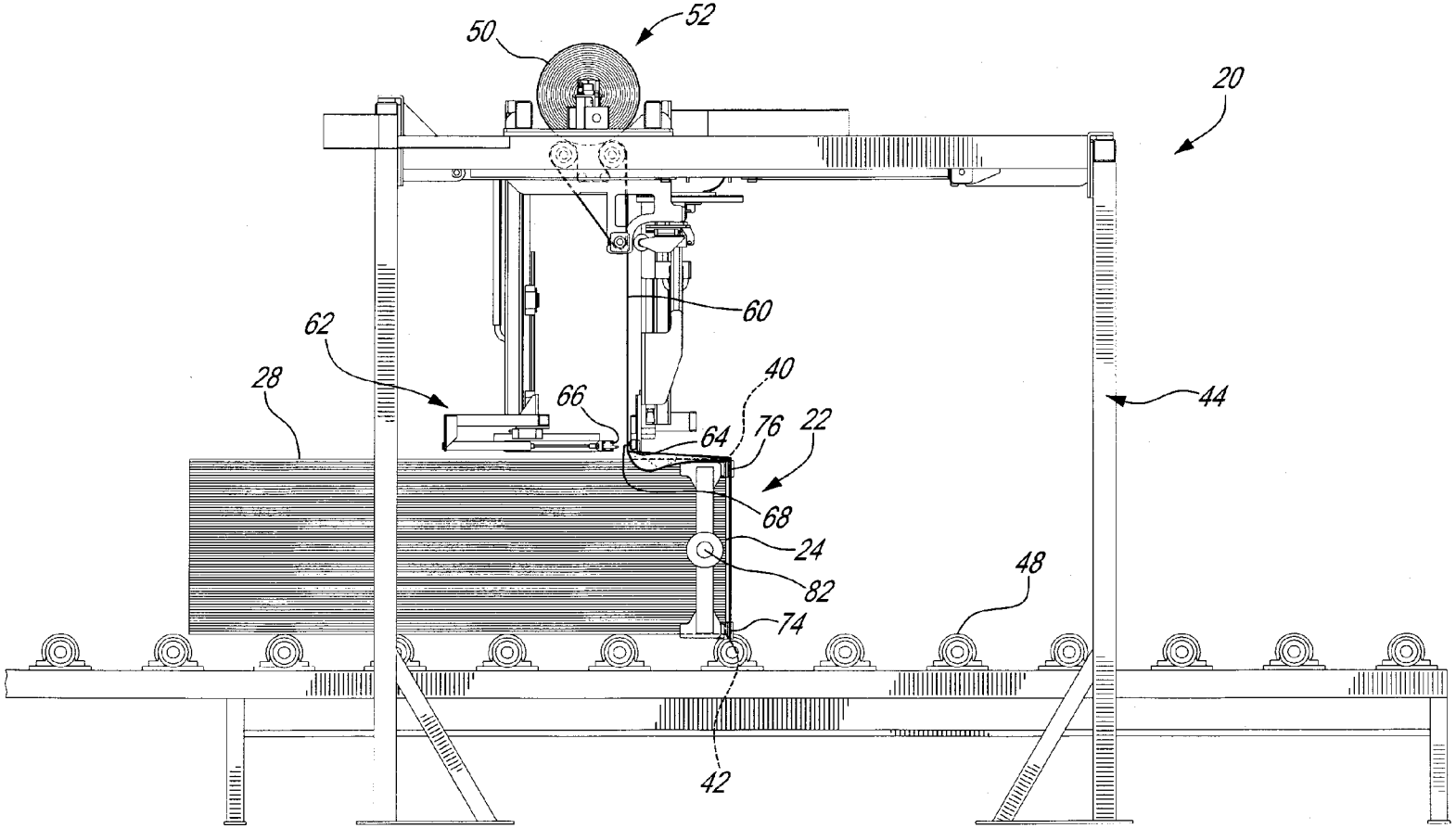
FIG. 3A is a side elevation view of the wrapping apparatus shown in FIG. 1 showing a wrapping step where a section of the wrapper material is applied to a front end face of the article.

Referring to FIG. 3A, a relative movement is provided between the wrapper material 60 and the article 22 to be wrapped wherein either the article 22 is conveyed along the conveyor 48 to the wrapping station or the wrapper material 60 is moved towards the front end face 24 of the article 22. In a particular embodiment, the conveyor 48 is omitted, and the wrapper material 60 is brought in place over the article 22. In the embodiment shown, the wrapper gripping units 72 are displaced forwardly, in front of the front end face 24, while the article 22 remains at the same position. In a particular embodiment, the rotatable arm 82 is rotated during this movement, such that the wrapper gripping units 72 are displaced from the initial vertically aligned position, to a configuration with the second arm section 86 extending horizontally as the wrapper gripping units 72 travel over the upper face 28 of the article, and back to a vertical position with the first wrapper gripper being located under the second wrapper gripper 76 as the wrapper gripping units 72 reach the front end face 24. To supply wrapper material 60 during the relative movement, the wrapper dispenser 62 is in the dispensing configuration. It is appreciated that, in alternate embodiments, the relative movement can be provided from the article or from a combination of the wrapper material and the article.

Thus, the wrapper material 60 is folded around the upper transversal edge 40 and superposed to the first end face 24 of the article 20, and a lower edge of the wrapper material 60 is substantially aligned with the lower transversal edge 42 of the article 22. The wrapper material 60 is substantially aligned transversally with the article 22, i.e. it extends substantially equally beyond both front lateral edges 32 of the article 22. The positions of the first and the second wrapper grippers 74, 76 correspond respectively and substantially to the height of the lower edges 36, 42 and of the upper edges 38, 40 of the article 22.

Figure 3B:
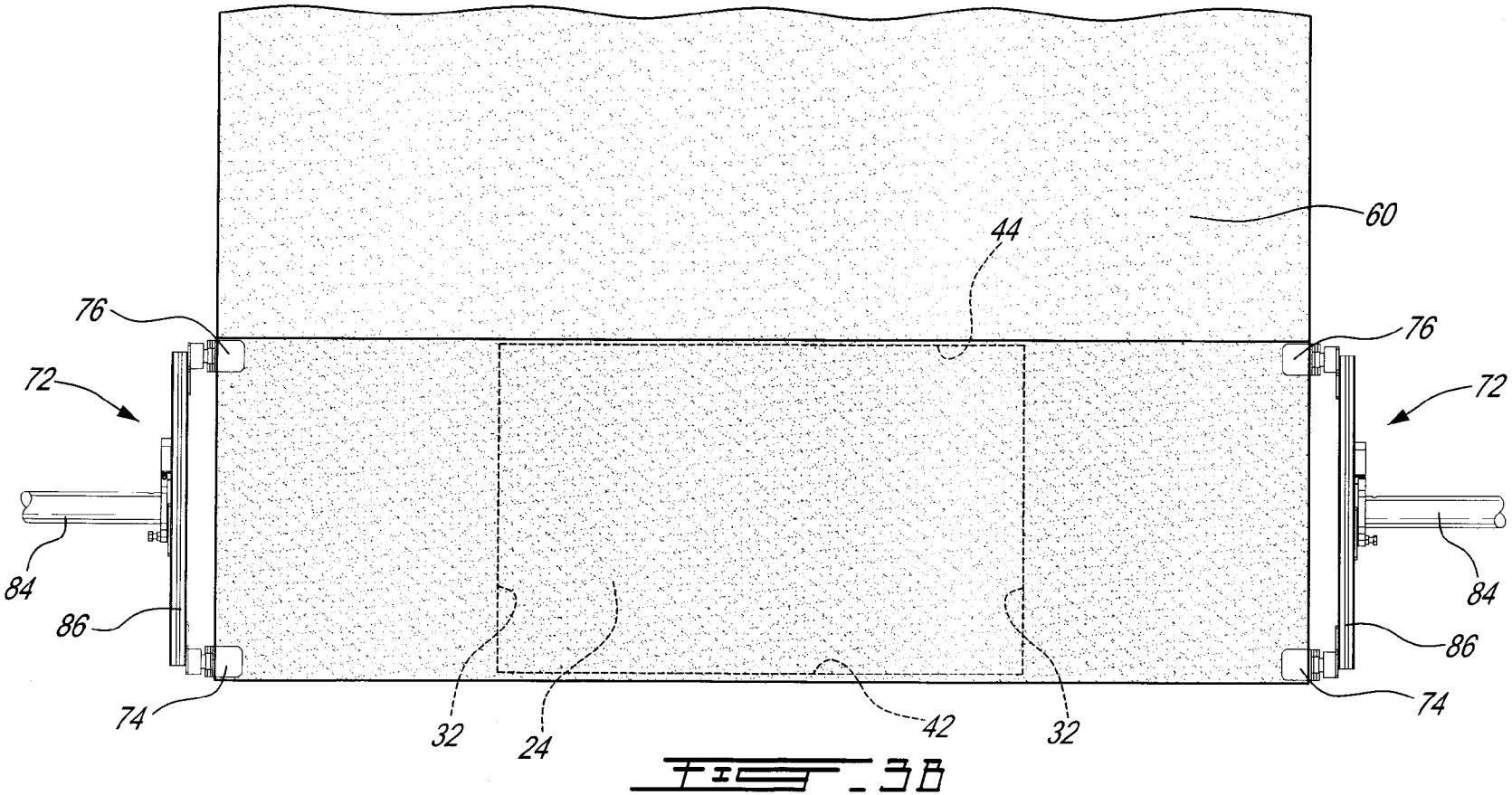
FIG. 3B is a schematic front view of the article during the step illustrated in FIG. 3A.

As shown in FIG. 3B, the wrapper gripping units 72 extend the wrapper material 60 beyond the front lateral edges 32 of the article 22 until a first predetermined target is reached. As mentioned above, the wrapper gripping units 72 are controlled and, more particularly, they are operatively connected to a servomotor. Thus, the displacement of the wrapper gripping units 72, holding the wrapper material 60, stops when the first predetermined target is reached. As mentioned above, the target can be for example the position of the wrapper grippers 74, 76, the distance of the displacement carried out, the stress applied to the wrapper material and sensed by sensor(s), the torque within the wrapper grippers 74, 76, etc.

Figure 4:
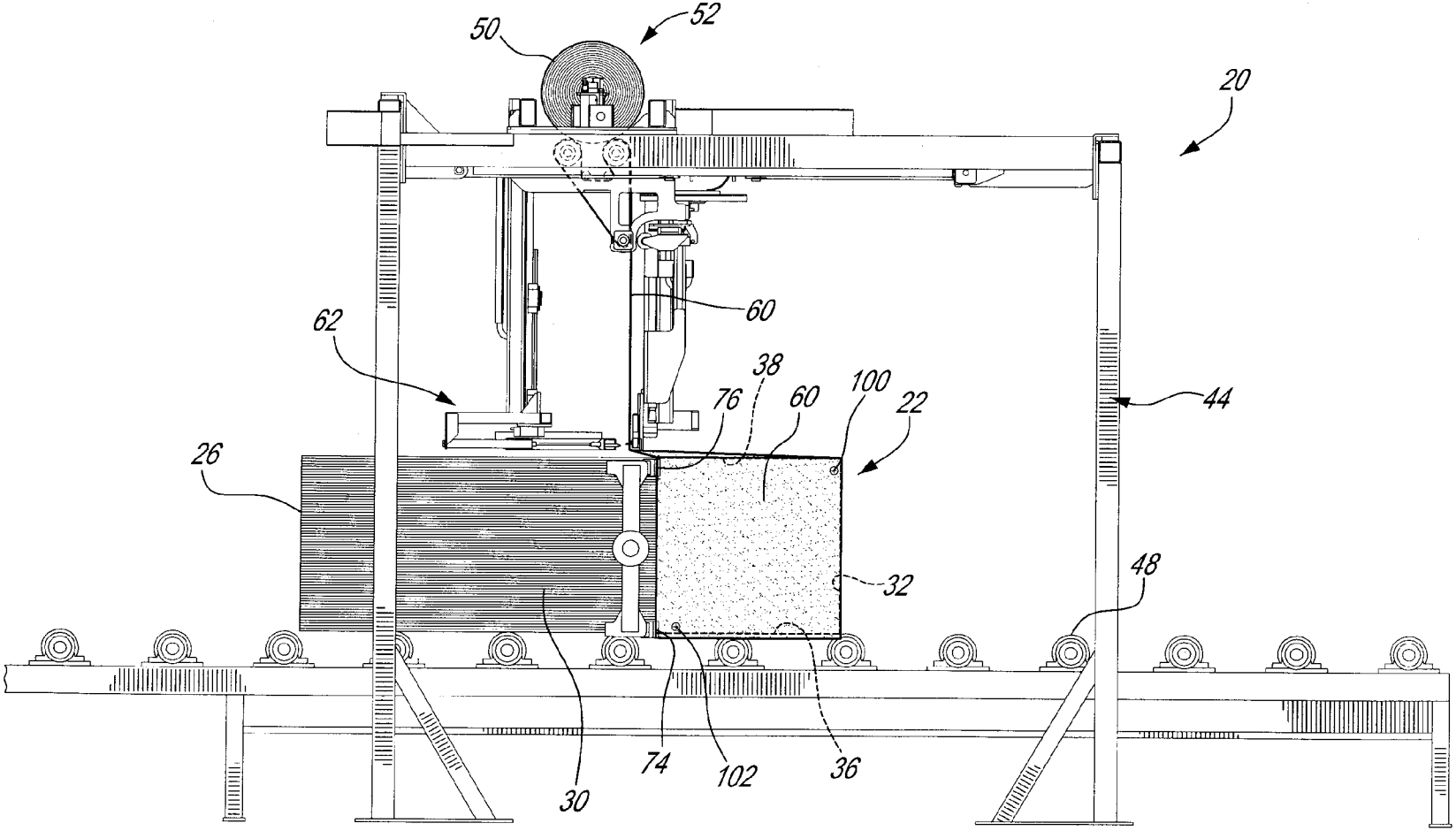
FIG. 4 is a side elevation view of the wrapping apparatus shown in FIG. 1, showing a wrapping step where sections of the wrapper material are folded around front lateral edges of the article and over lateral faces thereof.

Referring now to FIG. 4, there is shown a subsequent folding step wherein the wrapper gripping units with the second arm sections 86 still in a vertical orientation fold the section of the wrapper material 60 extending beyond each front lateral edge 32. Each section is folded around the respective lateral edge 32 and against the respective lateral face 30 until a second predetermined target is reached. Similar information than for the first predetermined target can be used for the second predetermined target.

For folding the wrapper material 60 around the front lateral edges 32, the wrapper gripping units 72 are displaced rearwardly, towards the rear end face 26, while remaining at the same height and thus maintaining a section of the wrapper material 60 covering the front end face 24. The first wrapper gripping configuration is maintained, i.e. the wrapper grippers 74, 76 do not release the wrapper material 60 during this folding step.

In the embodiment shown, during this folding step, the wrapper dispenser 62 is in a dispensing configuration. Alternately, if sufficient wrapper material is already provided to complete the folding step, the wrapper dispenser 62 can be in a non-dispensing configuration.

Then, the wrapper material 60 is secured to each lateral face 30, again without releasing the wrapper material 60. The wrapper material 60 is secured with a first fastener 100 to the corner of each lateral face 30 defined by the intersection of the respective front lateral edge 32 and of the respective upper longitudinal edge 38, and with a second fastener 102 near the corner of the wrapper material held by the first (lower) wrapper gripper 74, i.e. proximate to the lower longitudinal edge 36.

Figure 5:
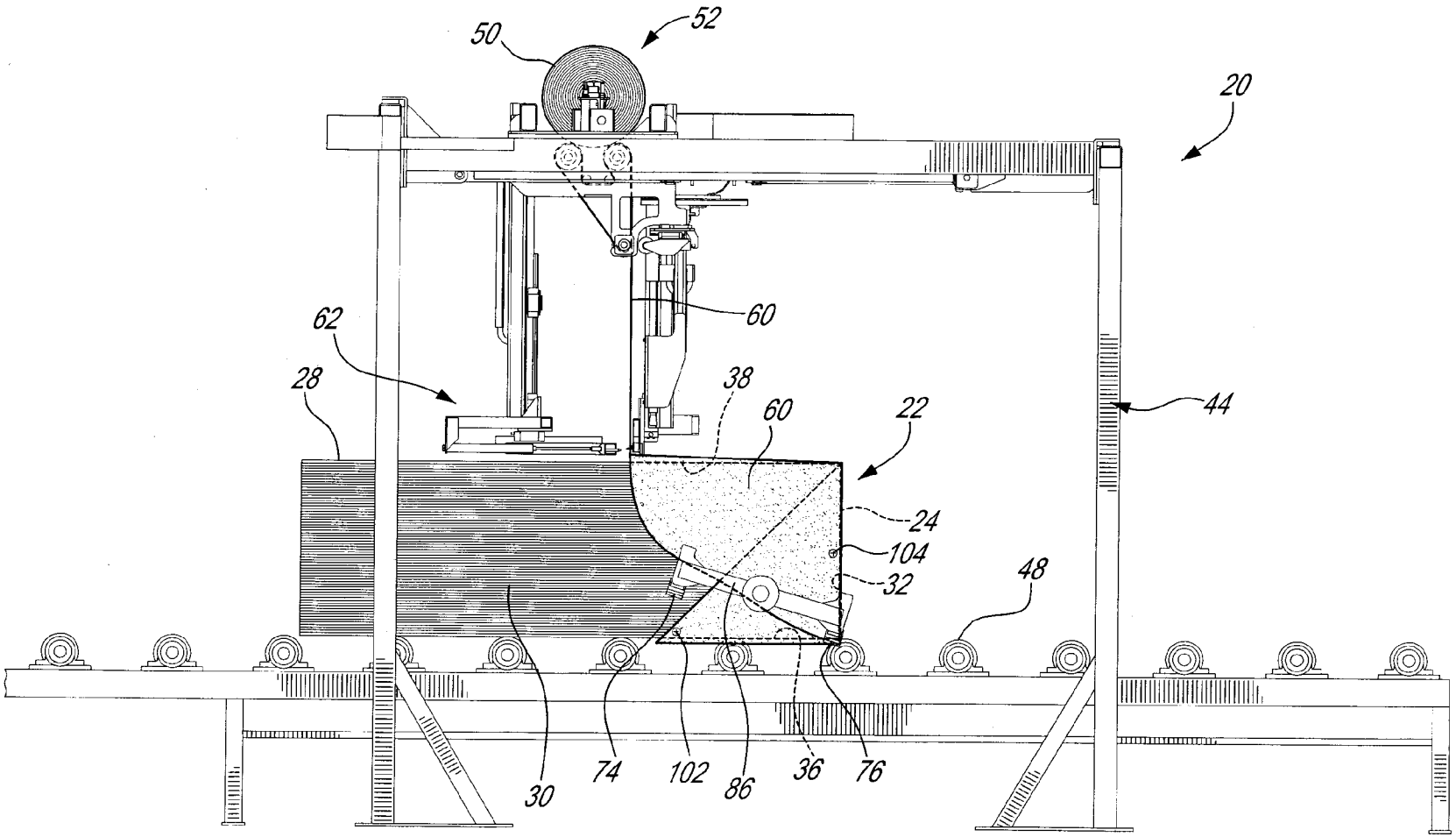
FIG. 5 is a side elevation view of the wrapping apparatus shown in FIG. 1, showing a wrapping step where sections of the wrapper material are folded around upper edges of the article and over the lateral faces.

Referring to FIG. 5, the gripping units 72 then switch to a second wrapper gripping configuration, where the first (lower) wrapper gripper 74 releases the wrapper material 60 while the second wrapper gripper 76 remains engaged to the wrapper material 60. In other words, the second wrapper gripper 76 remains engaged at a same location on the wrapper material 60 during the first and second wrapper gripping configurations. With the gripping units 72 now in the second wrapper gripping configuration, the rotatable arm 82 of each wrapper gripping unit 72 rotates to lower the second wrapper gripper 76. The second wrapper gripper 76 is thus displaced along the front lateral edge 32 toward the lower longitudinal edge 36 of the article 22, without releasing the wrapper material 60. The second arm section is tilted from the horizontal such that the second wrapper gripper 76 is slightly lower than and frontward of the first wrapper gripper 74. During this folding step, the wrapper dispenser 62 is in the dispensing configuration. Alternately, if sufficient wrapper material is already provided to complete the folding step, the wrapper dispenser 62 can be in a non-dispensing configuration.

Thus, in this folding step, the sections of the wrapper material 60 which extend over a width of the article upper face 28 proximate to the front end face 24 are folded around the respective upper longitudinal edge 38 and against the respective lateral faces 30 until a third predetermined target is reached. Similar information as for the previous predetermined targets can be used for the third predetermined target. As in the previous folding step, the second wrapper gripper 76 does not release the wrapper material as it is folded.

Once the third predetermined target is reached, the wrapper material 60 is secured to each lateral face 30 of the article 22 with a respective fastener 104 positioned near the front lateral edge 32 and the wrapper gripper 76, and the wrapper gripper 76 then releases the wrapper material. The wrapper material can be additionally secured by an additional fastener 106 (see FIG. 6) engaged at the position previously held by the wrapper gripper 76, i.e. near the lower longitudinal edge 36, once the wrapper material is released.

The front end of the article 22 is thus wrapped. In the next steps, the rear end of the article 22 will be wrapped, thus completing also the wrapping of the lateral faces 30 and of the upper face 28.

Figure 6:
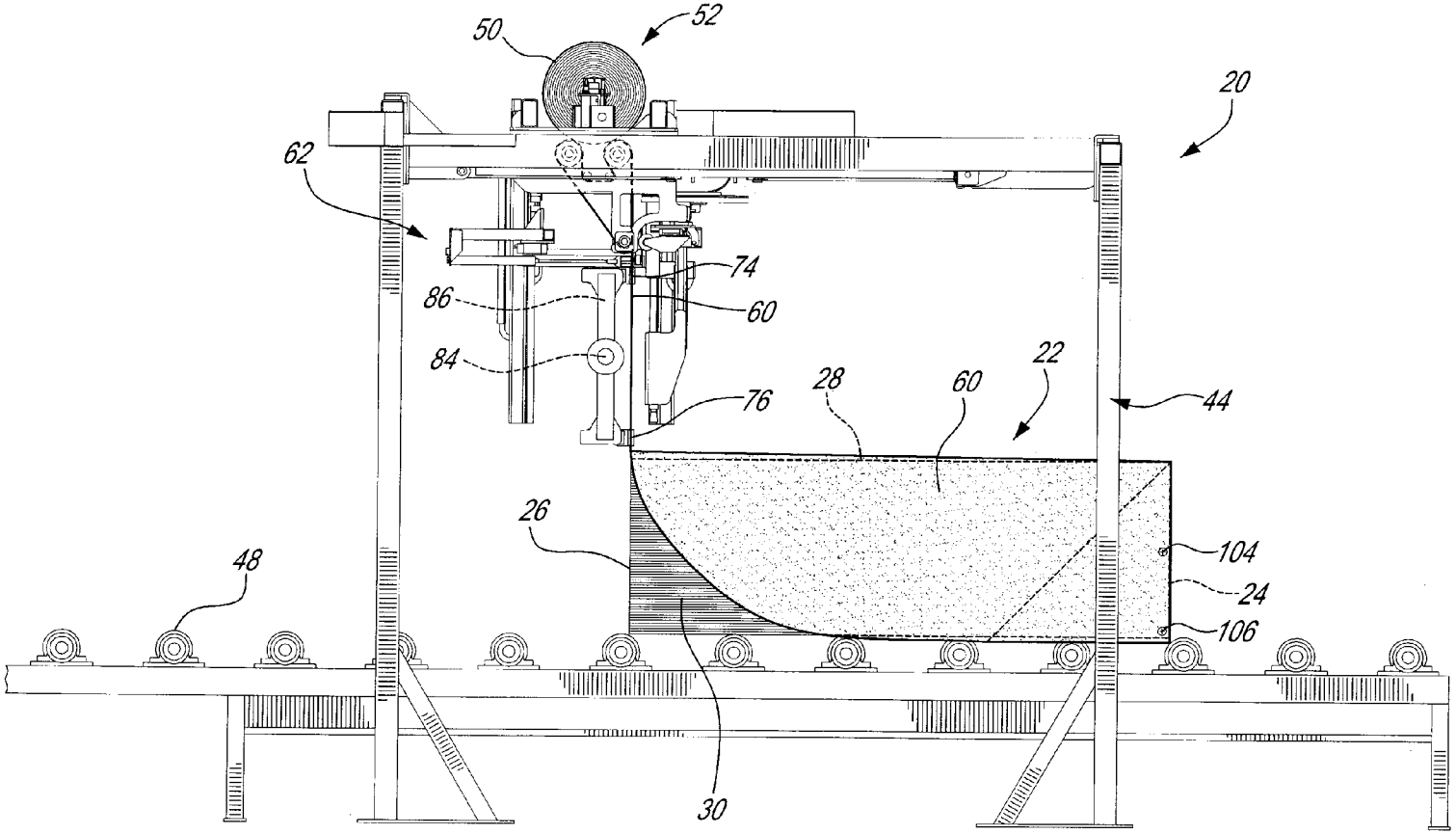
FIG. 6 is a side elevation view of the wrapping apparatus shown in FIG. 1, showing a wrapping step where the wrapper material is extended towards a rear end face of the article to cover an upper face thereof.

Referring to FIG. 6, a relative movement is provided between the article 22 to be wrapped and the wrapper material 60, such that the wrapper material 60 is applied to the upper face 28 and the lateral faces 30 towards the rear end face 26. To provide the relative movement, the article 22 can be further conveyed along the conveyor 48 and/or the wrapper material 60 can be moved towards the rear end face 26 of the article 22.

In the embodiment shown, to provide the relative movement, the article 22 is further conveyed along the conveyor 48.

The wrapper gripping units 72 grab the longitudinal edges of the wrapper material 60 proximate to the wrapper dispenser 62 in the first wrapper gripping configuration, this time with the second wrapper gripper 76 located below the first wrapper gripper 74, with the wrapper dispenser 62 in the lower position (as shown in FIG. 5). As such each wrapper gripping unit 72 grabs the wrapper material 60 proximate to a respective one of the longitudinal edges thereof, proximate to a rear edge. The first wrapper gripper 74 of each wrapper gripping unit 72 is located proximate to where the corner of the wrapper material 60 will be located. The second wrapper gripper 76 is spaced apart along the longitudinal edge of the wrapper material 60 from the first wrapper gripper 74. The second arm section 86 of each wrapper gripping unit 72 extends along a substantially vertical axis.

Either prior to, simultaneously with or following the relative movement, but after the wrapper gripping units 72 grab the wrapper material 60, the wrapper material 60 is cut to a desired length. The length of the wrapper material 60 is adjustable in accordance with the size of the article 22 being wrapped.

The wrapper dispenser 62, in the dispensing configuration, dispenses the length of wrapper material 60 necessary to wrap the article 22 and then, the moveable arm **63*b* moves to the non-dispensing configuration. The wrapper dispenser 62** remains in the non-dispensing configuration until another article is carried to the wrapping station to be wrapped.

Figure 7:
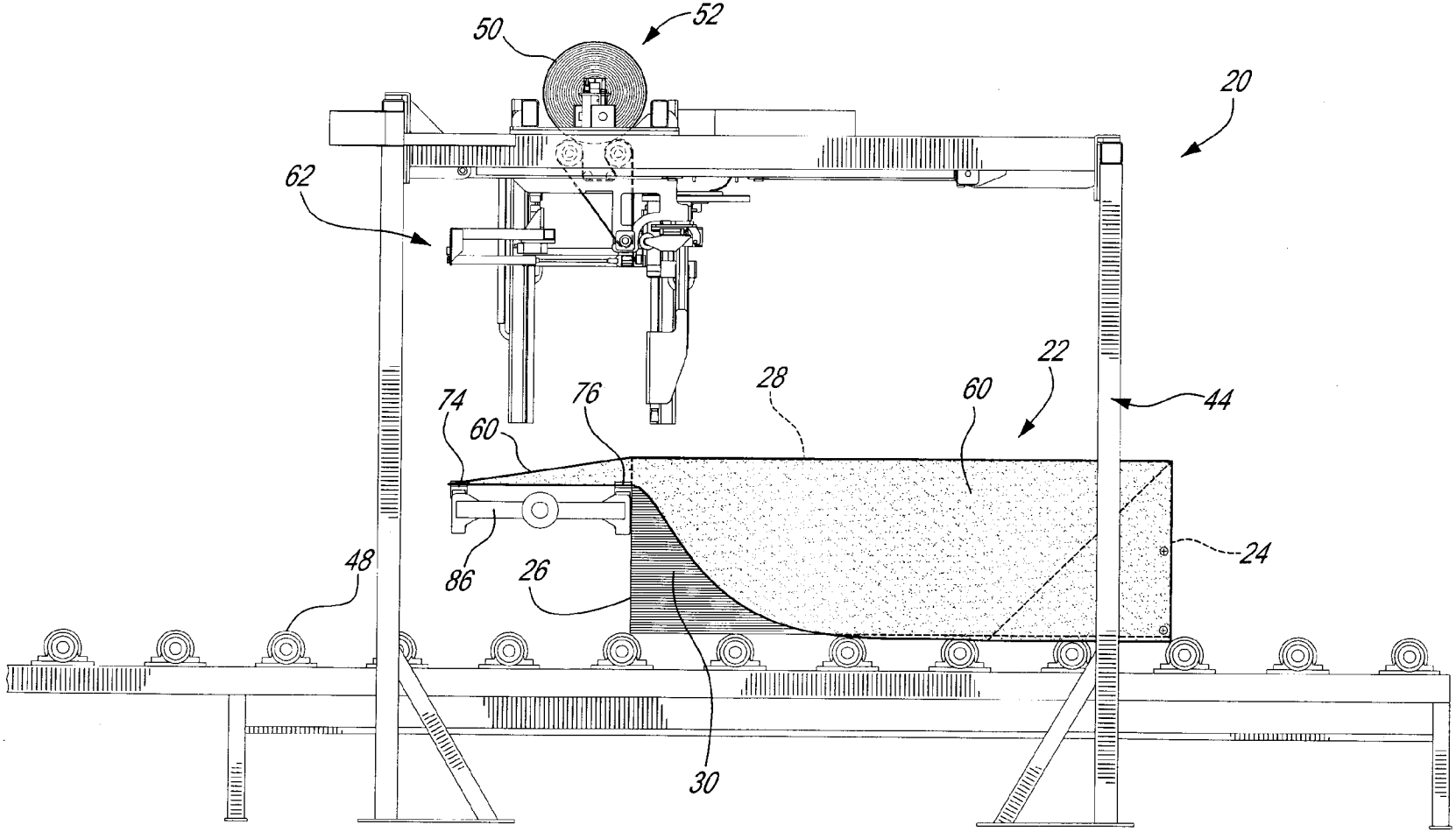
FIG. 7 is a side elevation view of the wrapping apparatus shown in FIG. 1, showing a wrapping step where the wrapper material is cut and extended beyond the rear end face.

Now referring to FIG. 7, the rotatable arm 82 of the wrapper gripping units 72 is rotated until the second arm section 86 of each wrapper gripping units 72 extends along a substantially horizontal axis and below the upper face 28 of the article. The gripping units 72 move rearwardly and laterally away from the article, so that the wrapper material 60 is extended beyond the rear end face 26 of the article 22 until a fourth predetermined target is reached. Similar information can be used for the fourth predetermined target as for the previous targets.

Figure 8:
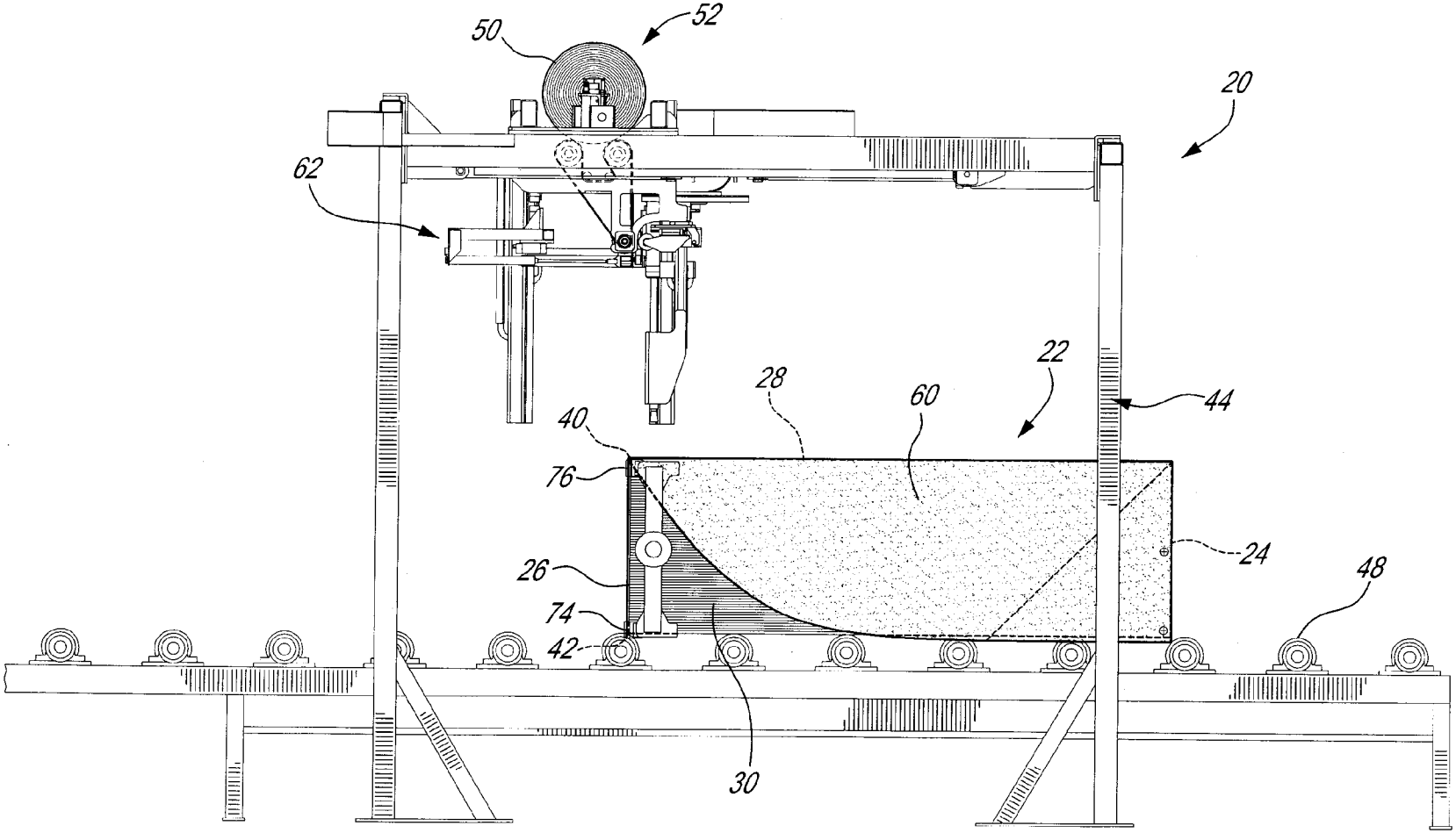
FIG. 8 is a side elevation view of the wrapping apparatus shown in FIG. 1, showing a wrapping step where the wrapper material is folded around an upper edge of the article and over the rear end face.

Then, referring to FIG. 8, the wrapper gripping units 72 fold the portion of the wrapper material 60 which extends rearwardly from the article 22 around the upper transversal edge 40. For carrying this folding step, the rotatable arm 82 is rotated 180° until the second arm section 86 of each wrapper gripping unit 72 extends along a substantially vertical axis with the first wrapper gripper 74 being below the second wrapper gripper 76. The gripping units 72 are laterally spaced apart from the article such as to extend the wrapper material on each side of the article, similarly to the position shown in FIG. 3B. The wrapper material 60 is thus folded against the rear end face 26 of the article. The wrapper gripping units 72 are rotated until a fifth predetermined target is reached. Similar information can be used for the fifth predetermined target as for the previous targets.

When the wrapper material 60 is folded against the rear end face 26 of the article, the positions of the first and the second wrapper grippers 74, 76 correspond respectively and substantially to the height of the lower edges 36, 42 and the upper edges 38, 40 of the article 22.

Figure 9:
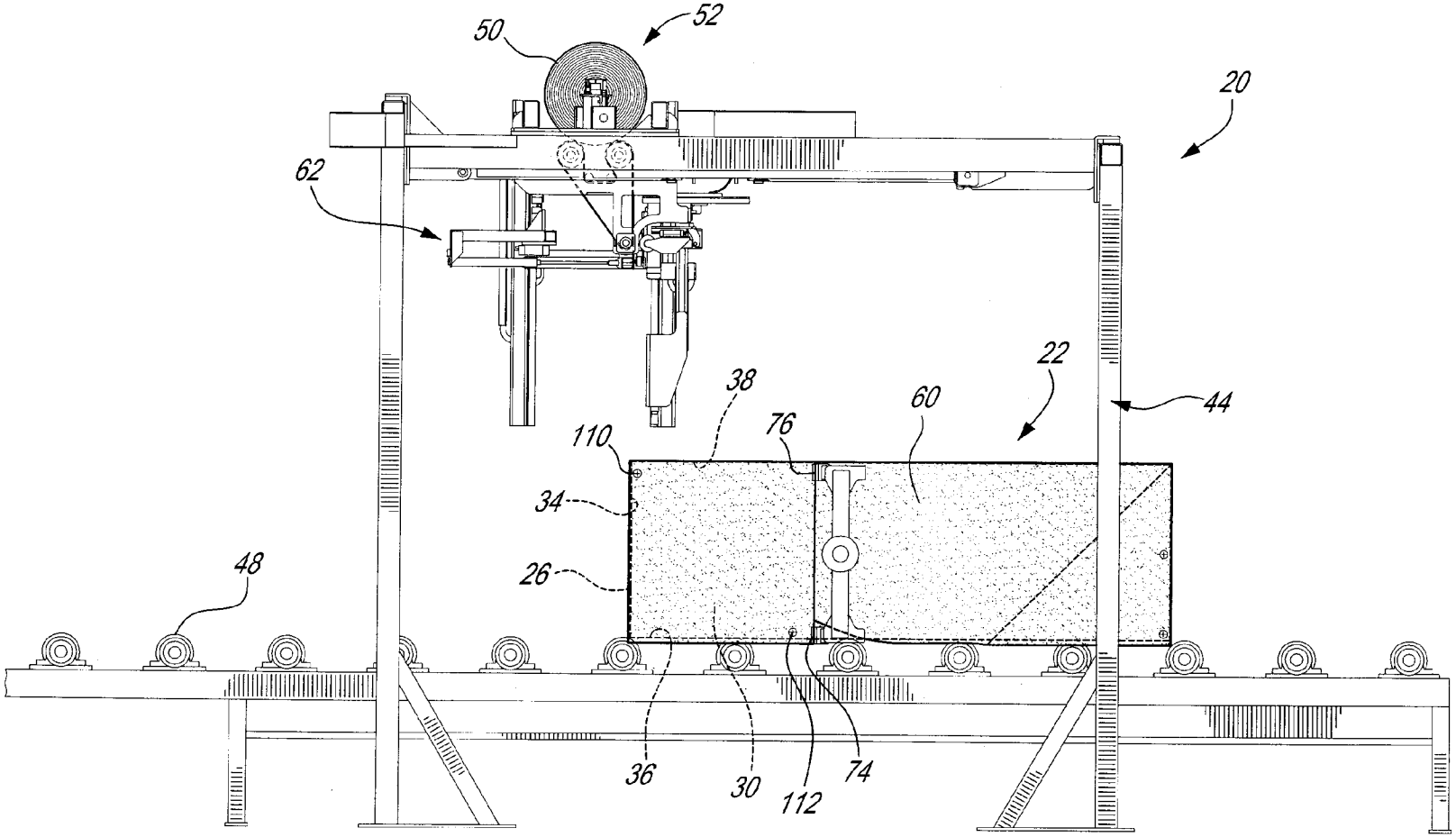
FIG. 9 is a side elevation view of the wrapping apparatus shown in FIG. 1, showing a wrapping step where sections of the wrapper material are folded around rear lateral edges of the article and over the lateral faces.

Then, as shown in FIG. 9 and with the wrapper gripping units still in the first wrapper gripping configuration, the wrapper gripping units 72 are moved frontwardly and towards the lateral faces 30 of the article to fold the portions of the wrapper material 60 which extend over the width of the rear end face 26 around the rear lateral edges 34 of the article 22. The wrapper material 60 is folded against the corresponding lateral faces 30 until a sixth predetermined target is reached. Similar information as for the previous predetermined targets can be used for the sixth predetermined target.

For folding the wrapper material 60 around the rear lateral edges 34, the wrapper gripping units 72 are displaced forwardly, towards the front end face 24, while remaining at the same height and maintaining a section of the wrapper material 60 covering the rear end face 26. The wrapper grippers 74, 76 do not release the wrapper material 60 during this folding step.

Then, the wrapper material 60 is secured to each lateral face 30, again without releasing the wrapper material. The wrapper material 60 is secured to the corner of the lateral face 30 defined by the intersection of the rear lateral edge 34 and the upper longitudinal edge 38 with a first fastener 110, and proximate to the corner of the wrapper material 60 held by the first (lower) wrapper gripper 74, i.e. proximate to the lower longitudinal edge 36 of the article 22, with a second fastener 112.

Figure 10:
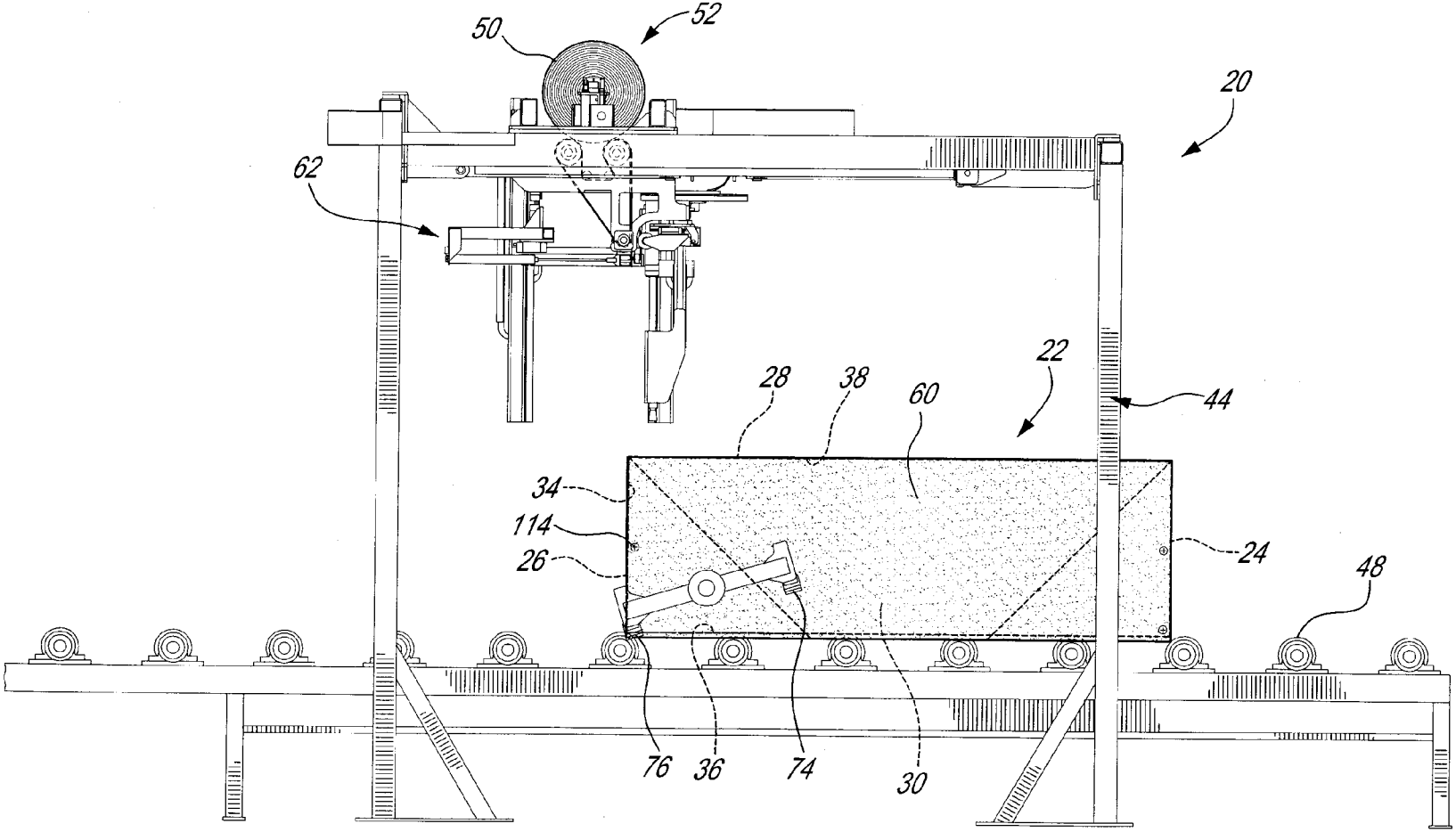
FIG. 10 is a side elevation view of the wrapping apparatus shown in FIG. 1, showing a wrapping step where sections of the wrapper material are folded around upper edges of the article and over the lateral faces.

Referring to FIG. 10, the gripping units 72 then switch to the second wrapper gripping configuration, where the first (lower) wrapper gripper 74 releases the wrapper material 60 while the second wrapper gripper 76 remains engaged to the wrapper material 60. The rotatable arm 82 of the wrapper gripping units 72 rotates to lower the second wrapper gripper 76. The second wrapper gripper 76 is thus displaced along the rear lateral edge 34 toward the lower longitudinal edge 36 of the article 22, without releasing the wrapper material 60. It is moved to fold the portions of the wrapper material 60, which extend over a width of the upper face 28 and proximate to the rear end face 26 around the upper longitudinal edges 38 of the article 22 and against the lateral faces 30. The gripping units 72 are thus moved so that the second arm section is tilted from the horizontal such that the second wrapper gripper 76 is slightly lower than the first wrapper gripper 74. The second wrapper gripper 76 is moved until a seventh predetermined target, which is similar to the previously described targets, is reached, without releasing the wrapper material 60.

Then, the wrapper material 60 is secured to each lateral face 30 of the article 22 with a respective fastener 114 positioned near the rear lateral edge 34 and the wrapper gripper 76, and the wrapper gripper 76 then releases the wrapper material. The wrapper material can be additionally secured by an additional fastener 116 (see FIG. 11) engaged at the position previously held by the wrapper gripper 76, i.e. near the lower longitudinal edge 36, once the wrapper material is released.

In a particular embodiment, the fasteners 100, 102, 104, 106, 110, 112, 114, 116 include nails or staples. Alternate types of fasteners can also be used, and alternate fastening means can replace the fasteners 100, 102, 104, 106, 110, 112, 114, 116, such as for example an adequate type of adhesive, or fusion of the wrapper material 60 on the article.

Figure 11:
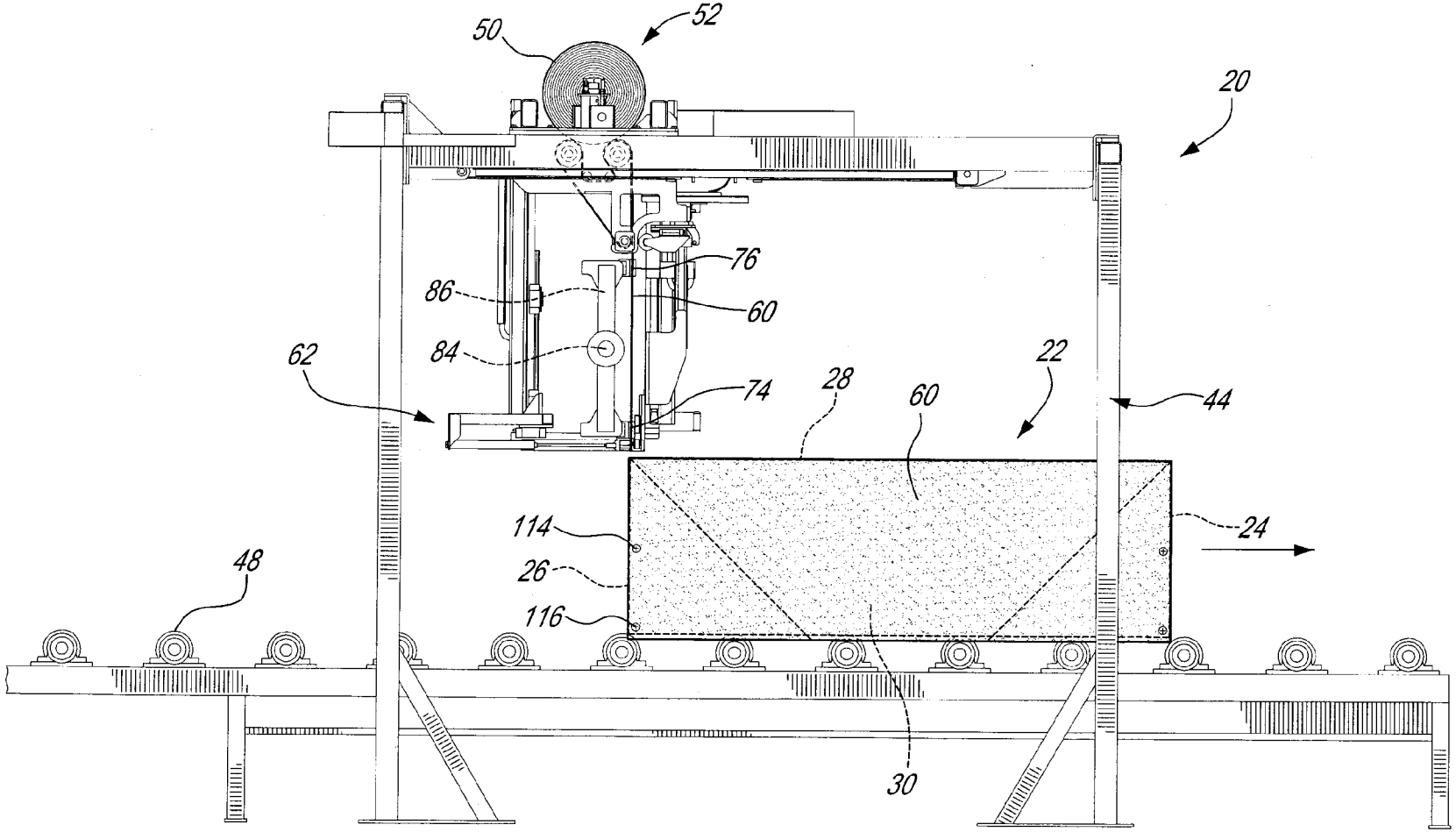
FIG. 11 is a side elevation view of the wrapping apparatus shown in FIG. 1, showing the article completely wrapped and moving away from the wrapping station.

Referring to FIG. 11, the article 22 is thus wrapped and can continue its path along the conveyor 48. Another article can be moved to the wrapping station to be wrapped.

The wrapper gripping units remain engaged to the wrapper material throughout the wrapping of the forward portion of the article, and disengage the wrapper material to re-engage it and remain in engagement therewith throughout the wrapping of the rearward portion of the article. In particular, one of the wrapper grippers remains engaged to a first same location on the wrapper material throughout a first part of the wrapping process, and remains engaged to a second same location on the wrapper material throughout a remaining part of the wrapping process.

As mentioned above, when targets are reached, the motion of the wrapper gripping units 72 stops and the next step begins. The wrapper gripping units 72 are operatively connected to a servomotor to provide energy for their displacement and control the latter. Depending on the needs, the targets can be, for instance and without being limitative, the position of the wrapper grippers 74, 76, the distance carried out, the stress applied to the wrapper material 60 and sensed by sensor(s) or the torque within the wrapper grippers 74, 76. In an embodiment, the various steps can be associated with different target types. For example and without being limitative, the first predetermined target can be a wrapper gripper position while the second predetermined target can be the distance carried by the wrapper grippers. Moreover, if several predetermined targets are of the same type, the values associated with each predetermined target can be the same or can be different.

Now an alternate method for wrapping an article 22 will be described in reference to FIGS. 13 to 25, wherein the wrapper material is folded and secured to the front and rear end faces 24, 26 of the article 22.

Figure 13:
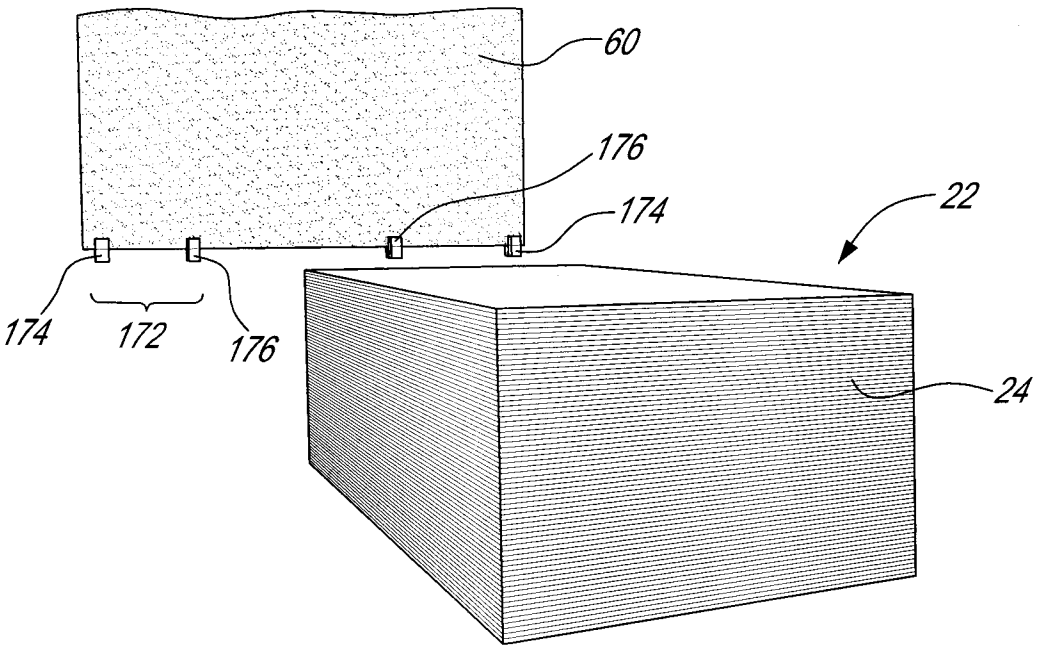
FIG. 13 is a perspective schematic view of an article being wrapped in accordance with an alternate embodiment of the present invention, showing a wrapping step where the wrapper material is grabbed.

Referring to FIG. 13, the wrapper material 60 extending from the web material roll is grabbed by two wrapper gripping units 172 each including a pair of wrapper grippers 174, 176. In one particular embodiment, the wrapper gripping units 172 are similar to the wrapper gripping units 72 of the embodiment previously described. In an alternate embodiment, each wrapper gripping unit 172 is a human being, with each hand thereof playing the role of one of the wrapper grippers 174, 176. In an alternate embodiment, each wrapper gripping unit 172 is part of an adequate wrapping machine different than that shown in the previous figures.

Each wrapper gripping unit 172 grabs the wrapper material 60 along a front transversal edge thereof in a first gripping configuration. The first wrapper gripper 174 of each wrapper gripping unit is located proximate to a corner of the wrapper material 60. The second wrapper gripper 176 is spaced apart along the transversal edge of the wrapper material from the first wrapper gripper 174.

Figure 14:
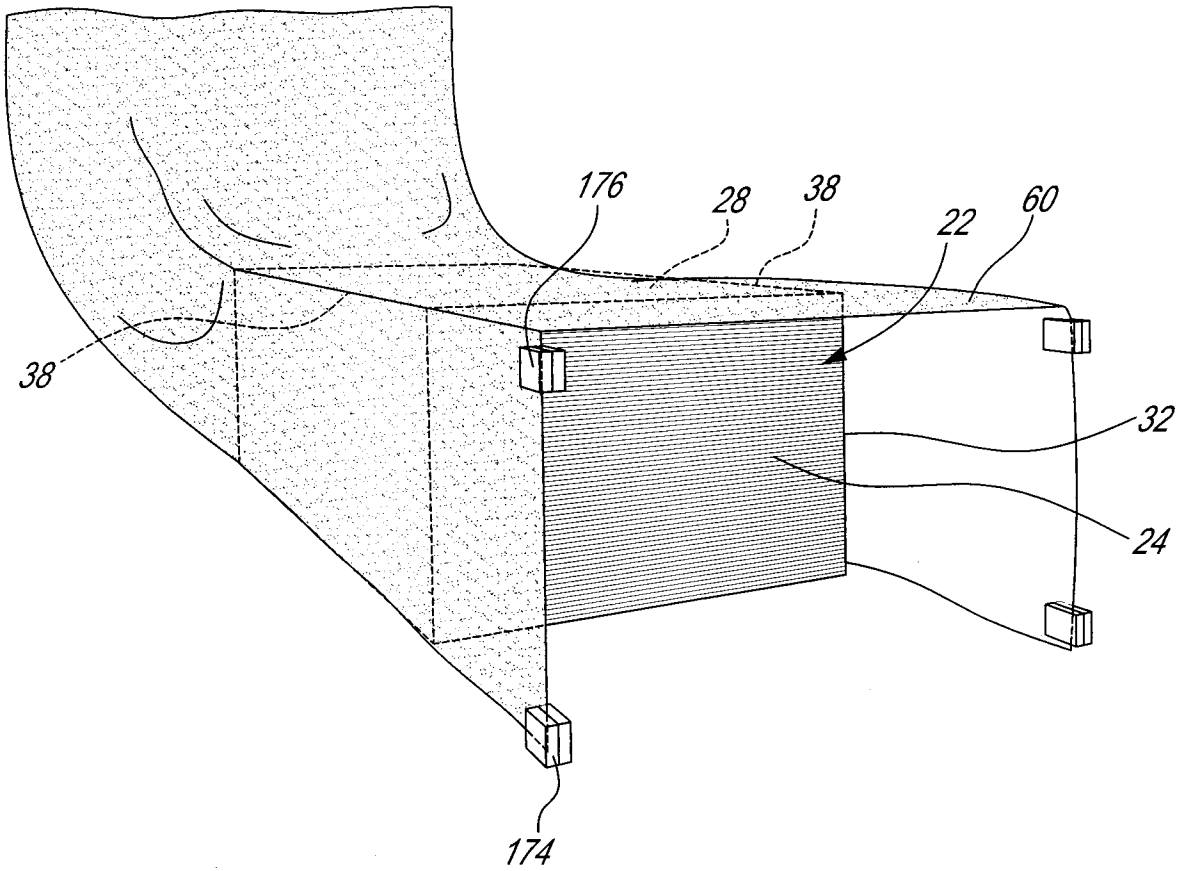
FIG. 14 is a perspective schematic view of the article of FIG. 13, showing a wrapping step where the wrapper material is extended beyond the front end face of the article and folded over the lateral faces thereof.

Referring to FIG. 14, a relative movement is provided between the wrapper material 60 and the article 22 to be wrapped to superpose the wrapper material 60 to a section of the upper face 28 of the article 22 and fold the wrapper material 60 about the upper longitudinal edges 38 of the article. The wrapper material 60 is extended past the front end face 24 and the front lateral edges 32 of the article.

Figure 15:
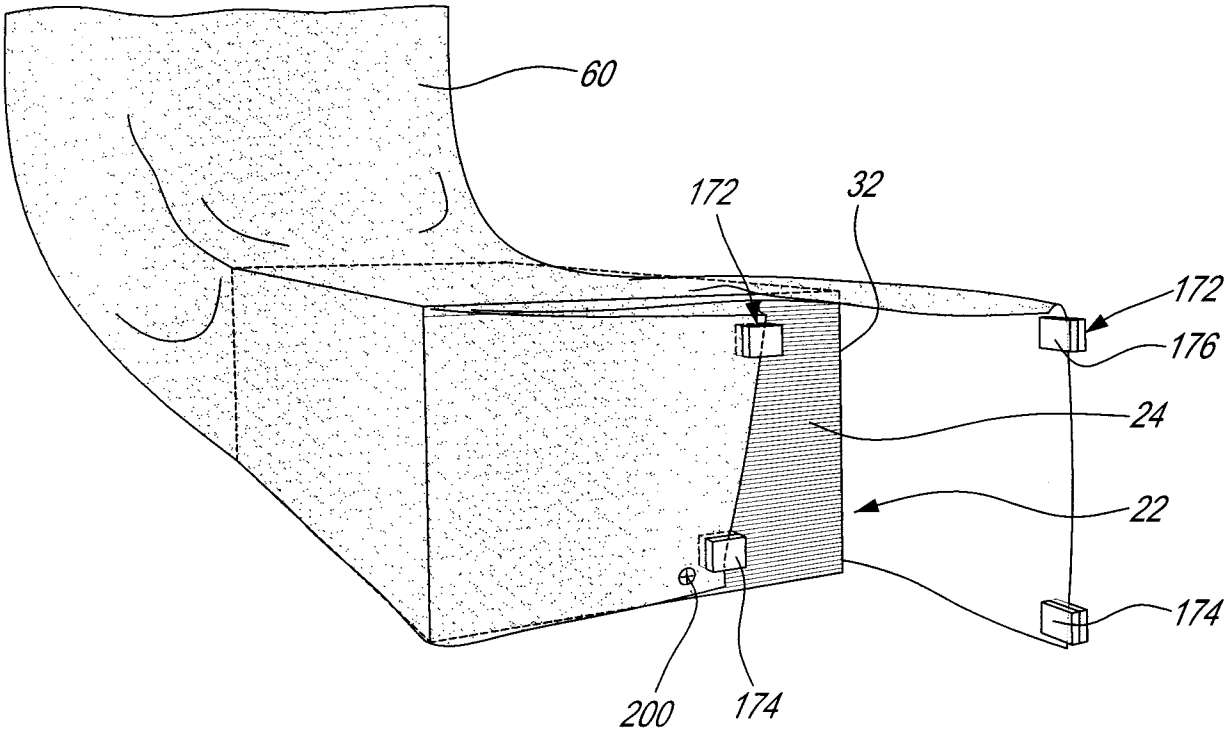
FIGS. 15, 16 and 17 are perspective schematic views of the article of FIG. 13, showing successive wrapping steps where the sections of the wrapper material are folded around front lateral edges of the article and over the front end face thereof.
Figure 16:
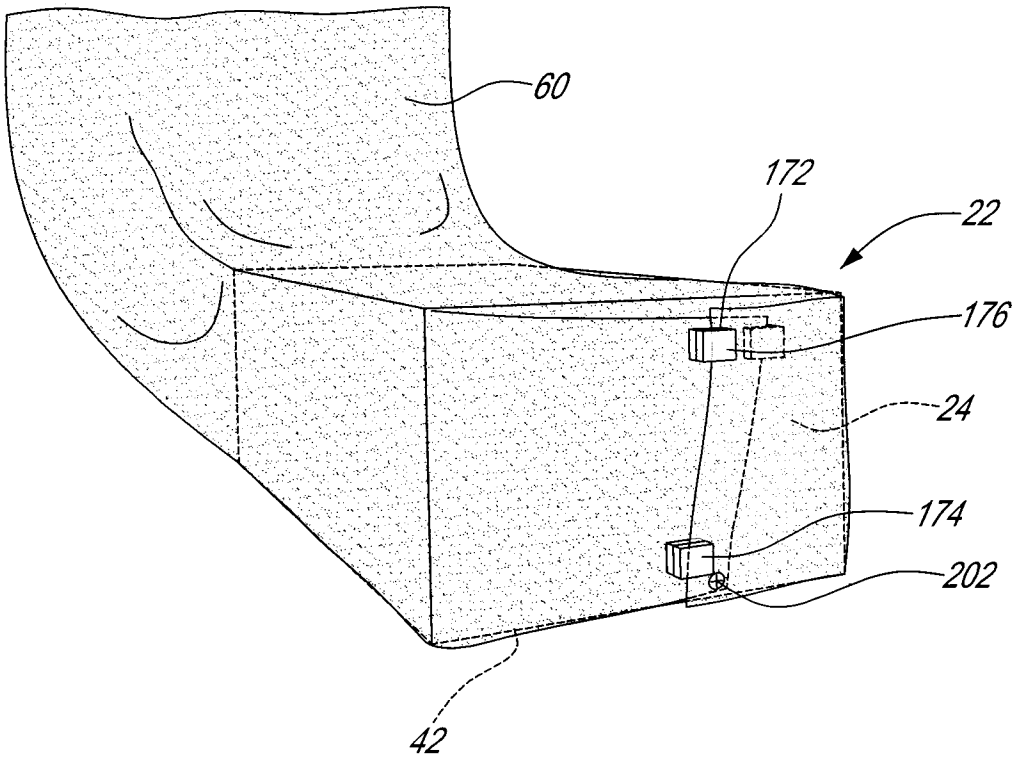

Referring now to FIGS. 15 and 16, there is shown a subsequent folding step wherein the wrapper gripping units 172 fold the portions of the wrapper material 60 extending beyond the front lateral edges 32. This portion of the wrapper material is folded around these lateral edges 32 and against the article front end face 24 until a predetermined target is reached. Similar information than for the predetermined targets of the first wrapping embodiment can be used for this target and the following targets of this embodiment.

For folding the wrapper material around the front lateral edges 32, the wrapper gripping units are displaced towards the front end face 24 while remaining at the same height. Both sides of the wrapper material 60 can be folded simultaneously or sequentially.

Then, the wrapper material 60 is secured to the front end face 24 of the article, proximate to the corners of the wrapper material 60, i.e. proximate to the lower transversal edge 42 of the article being wrapped, with a fastener 200, 202 positioned proximate to the first wrapper gripper 174, i.e. the lower one. The first wrapper gripper 174 does not release the wrapper material 60 until the latter is secured to the article.

Once the respective fastener 200, 202 retains the portion of the wrapper material 60 to the front end face 24, the respective gripping unit 172 switches to a second wrapper gripping configuration, where the first (lower) wrapper gripper 174 releases the wrapper material 60 while the second wrapper gripper 176 remains engaged to the wrapper material 60. In other words, the second wrapper gripper 176 remains engaged at a same location on the wrapper material 60 during the first and second wrapper gripping configurations.

Figure 17:
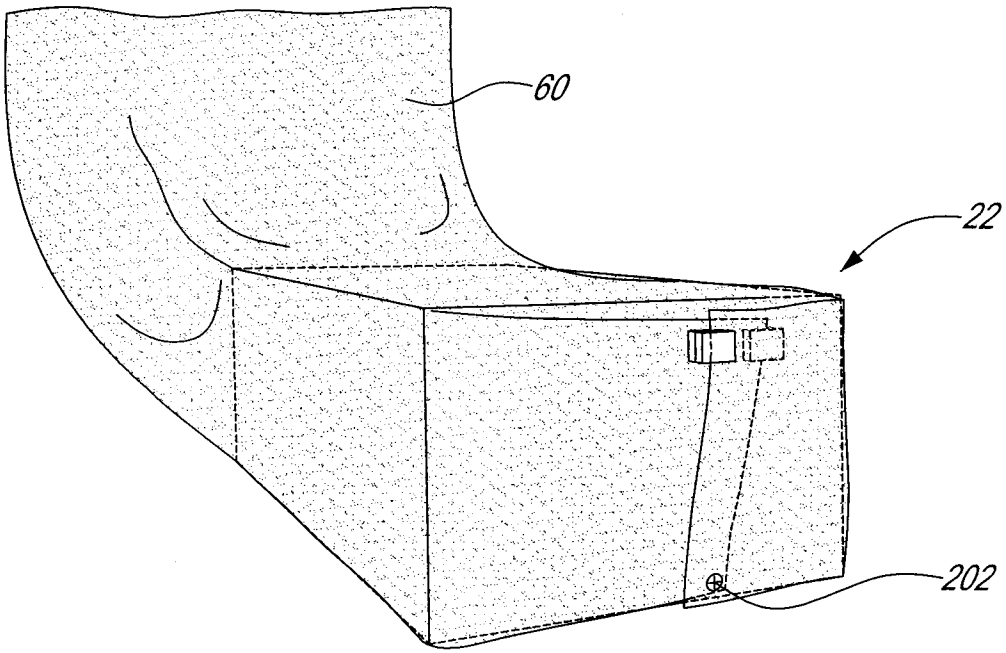

Thus, when the wrapper material 60 is secured to the article, the first wrapper gripper 174 of each gripping unit 172 releases the wrapper material. FIG. 17 shows both wrapper gripping units 172 in the second gripping configuration.

Figure 18:
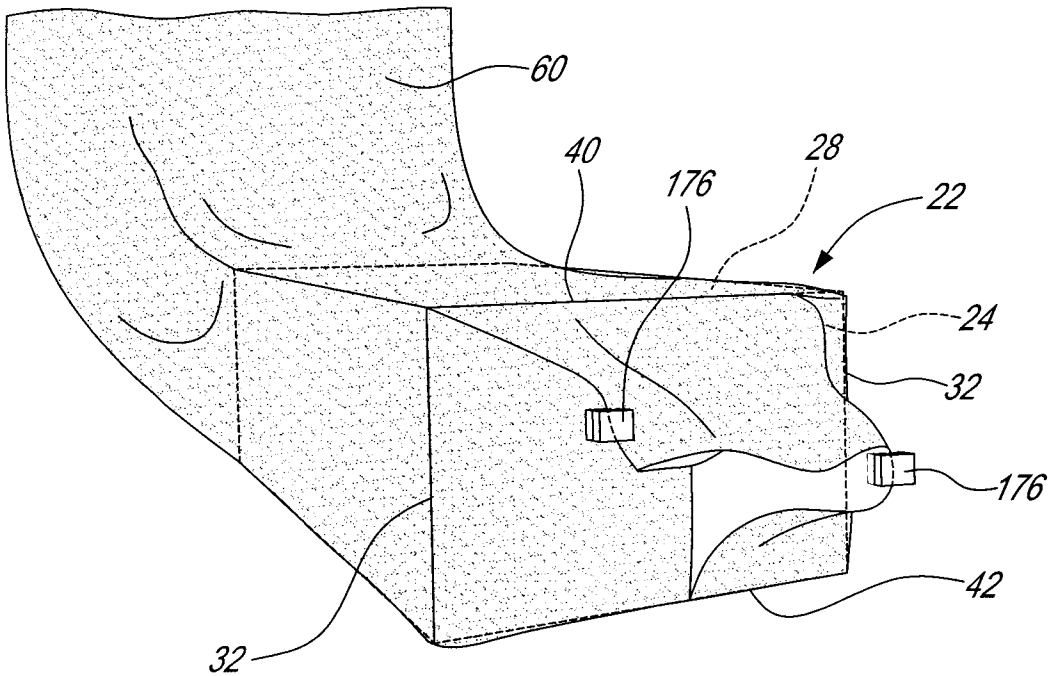
FIGS. 18 and 19 are perspective schematic views of the article of FIG. 13, showing successive wrapping steps where a section of the wrapper material is folded around an upper edge of the article and over the front end face.
Figure 19:
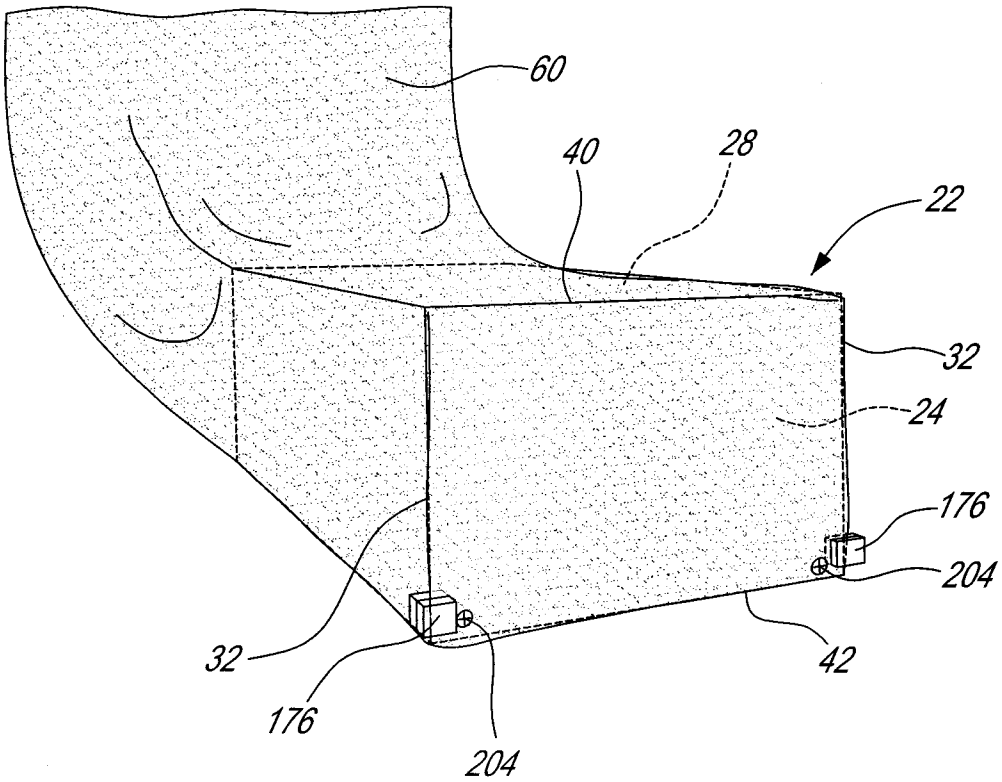

A subsequent folding step is carried out as shown in FIGS. 18 and 19. The second wrapper grippers 176 are each displaced towards the adjacent respective front lateral edge 32 and toward the lower transversal edge 42 of the article 22, without releasing the wrapper material 60.

Thus, in this folding step, the portion of the wrapper material 60 which extends over a length of the article upper face 28 proximate to the front end face 24 of the article is folded around the upper transversal edge 40 and against the front end face 24 until a predetermined target is reached.

Once the predetermined target is reached, the wrapper material 60 is secured to the article with fasteners 204, as shown in FIG. 19. The wrapper material 60 is secured to the front end face 24 of the article near the corners defined by the junction of the front lateral edges 32 and the lower transversal edge 42. The second wrapper grippers 176 do not release the wrapper material 60 until the wrapper material 60 is secured to the article.

The front end of the article 22 is thus wrapped. The gripping units 172 release the wrapper material 60, and grab it back in the first gripping configuration along the rear transversal edge to wrap the rear end of the article 22 together with the lateral faces and the upper face. The first wrapper gripper 174 of each wrapper gripping unit 172 is located proximate to a corner of the wrapper material 60. The second wrapper gripper 176 is spaced apart along the transversal edge of the wrapper material 60 from the first wrapper gripper 174.

A relative movement is provided between the article 22 to be wrapped and the wrapper material 60, such that the wrapper material is applied to the upper face 28 and the lateral faces 30 towards the rear end face 26. Either prior to, simultaneously with or following this relative movement, the wrapper material is cut to a desired length. The wrapper material 60 is extended beyond the rear end face 26 of the article 22 until a predetermined target is reached.

Figure 20:
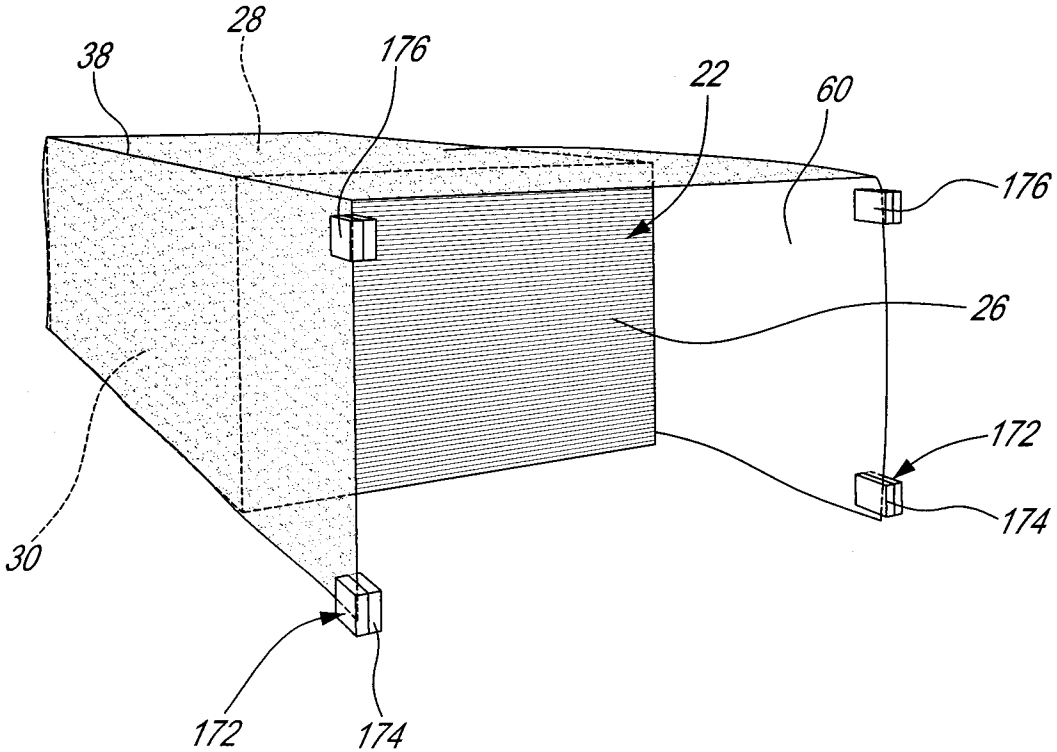
FIG. 20 is a perspective schematic view of the article of FIG. 13, showing a wrapping step where the wrapper material is extended beyond the rear end face of the article and applied over the upper face thereof.

Then, the wrapper gripping units 172 fold the portions of the wrapper material which extend over the width of the article around the upper longitudinal edges 38 against the lateral faces 30 of the article, as shown in FIG. 20. The wrapper gripping units 172 are displaced until a predetermined target is reached.

When the wrapper material 60 is folded against the lateral faces 30 of the article 22, the positions of the first and the second wrapper grippers 174, 176 correspond respectively and substantially to the height of the lower edges and of the upper edges of the article 22.

Figure 21:
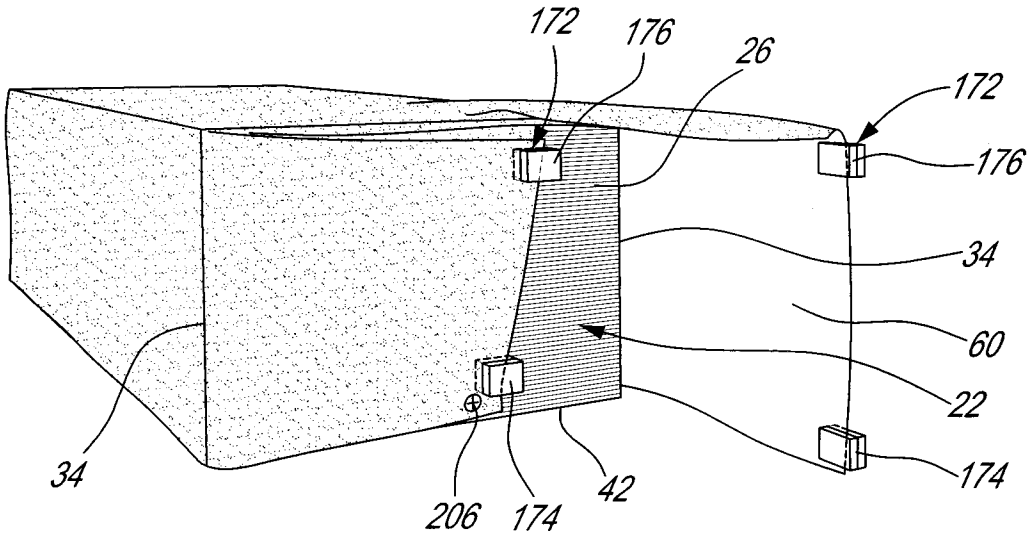
FIGS. 21 and 22 are perspective schematic views of the article of FIG. 13, showing successive wrapping steps where the sections of the wrapper material are folded around rear lateral edges of the article and over the rear end face thereof.
Figure 22:
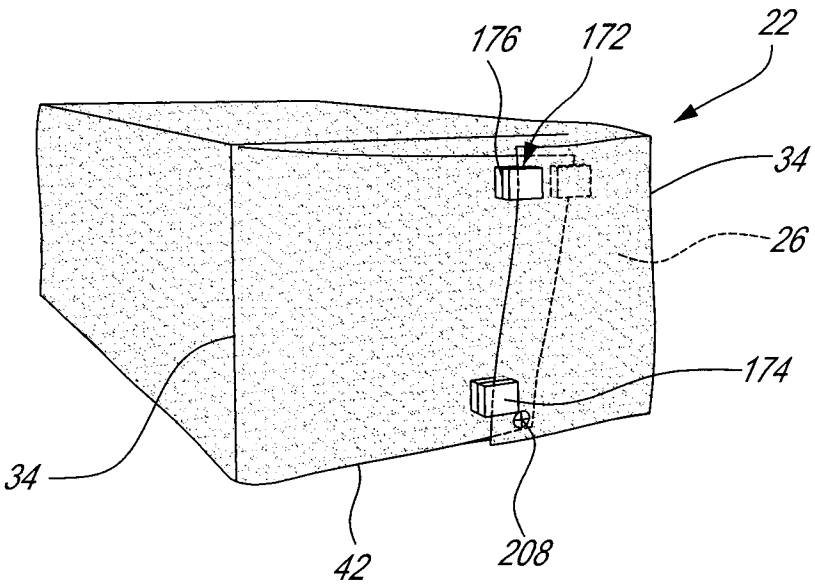

Then, as shown in FIGS. 21 and 22, the wrapper gripping units 172 are moved, simultaneously or sequentially, towards the rear end face 26 of the article to fold around the rear lateral edges 34 the portions of the wrapper material 60 which extend over the length of the article. The wrapper material is folded against the rear end face 26 until a predetermined target is reached.

For folding the wrapper material 60 around the rear lateral edges 34, the wrapper gripping units 172 are displaced towards the rear end face 26 while remaining at the same height.

Then, the wrapper material is secured to the rear end face 26 of the article, proximate to the lower transversal edge 42 and to the corners of the wrapper material 60, with fasteners 206, 208. The first wrapper grippers 174 do not release the wrapper material 60 until it is secured to the article.

Once the respective fastener 206, 208 retains the portion of the wrapper material 60 to the rear end face 26, the respective gripping unit 172 switches to the second wrapper gripping configuration, where the first (lower) wrapper gripper 174 releases the wrapper material 60 while the second wrapper gripper 176 remains engaged to the wrapper material 60. Thus, when the wrapper material 60 is secured to the article, the first wrapper gripper 174 of each gripping unit 172 releases the wrapper material.

When the first wrapper grippers 174 have released the wrapper material, a subsequent folding step is carried similarly to that shown in FIGS. 18 and 19 and previously described. The second wrapper grippers 176 are each displaced towards the adjacent respective rear lateral edge 34 and toward the lower transversal edge 42 of the article 22, without releasing the wrapper material 60.

Figure 23:
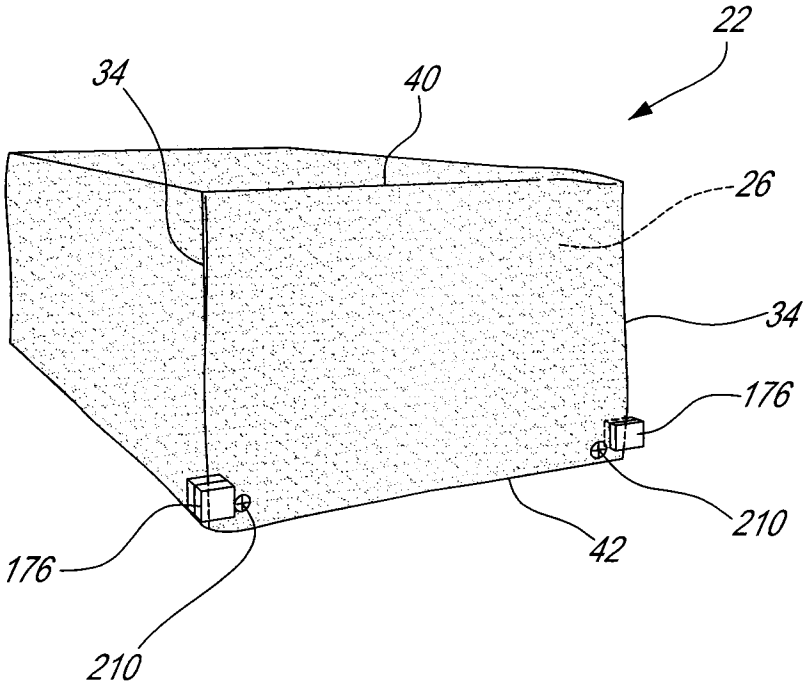
FIG. 23 is a perspective schematic view of the article of FIG. 13, showing the article after a section of the wrapper material has been folded around an upper edge of the article and over the rear end face.

Thus, in this folding step, the portion of the wrapper material 60 which extends over a length of the article upper face 28 proximate to the rear end face 26 of the article is folded around the upper transversal edge 40 and against the rear end face 26 until a predetermined target is reached, as shown in FIG. 23.

Then, the wrapper material is secured to the rear end face 26 with fasteners 210 provided in the corners defined by the junction of the lower transversal edge 42 with each rear lateral edge 34. The second wrapper grippers 176 do not release the wrapper material 60 until it is secured to the article.

The article is thus wrapped and can continue its path along the conveyor. Another article can be moved to the wrapping station to be wrapped.

Figure 12:
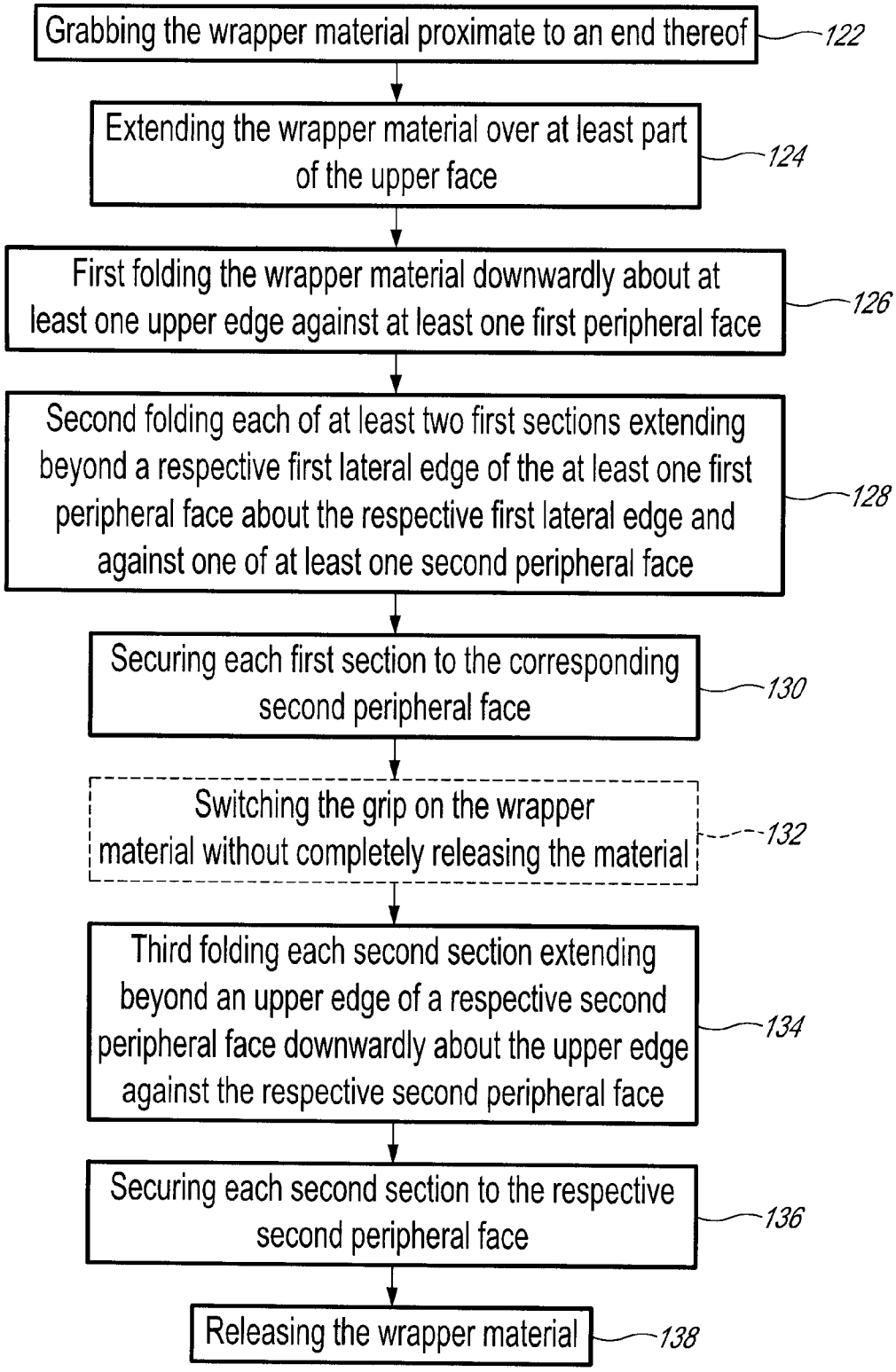
FIG. 12 is a flowchart showing schematically the various steps of a method to wrap an article.

Now referring to FIG. 12, an exemplary method for wrapping at least part of an article 22 will be further discussed below.

With the article to be wrapped moved to a wrapping station, the wrapper material is grabbed proximate an end thereof, as shown in step 122. In a particular embodiment, a front end is gripped with gripping units in a first configuration such as described above.

The wrapper material is extended over at least part of the upper face of the article, as illustrated in step 124. This can be done through a relative movement provided between the article to be wrapped and the wrapper material.

A first folding step 126 is performed, where the wrapper material is folded downwardly about at least one upper edge against at least one peripheral face of the article. For example, in the embodiment of FIGS. 2-11, the at least one peripheral face corresponds to the front end face 24, and the upper edge corresponds to the corresponding upper transversal edge 40. In the embodiment of FIGS. 13-23, the at least one peripheral face corresponds to the two lateral faces 30, and the upper edge corresponds to the respective upper longitudinal edge 38.

After this folding step, the wrapper material defines at least two first sections each extending beyond a respective first lateral edge of the at least one first peripheral face, as well as at least one second section each extending beyond an upper edge of a respective one of at least one second peripheral face adjacent the at least one first peripheral face. For example, in the embodiment of FIGS. 2-11, the at least one second peripheral face corresponds to the two lateral faces 30, two first sections each extend laterally from the front end face beyond a respective lateral edge thereof, and two second section each extend laterally from the upper face beyond the upper edge of the respective lateral face. In the embodiment of FIGS. 13-23, the at least one second peripheral face corresponds to the front end face 24, two first sections each extend frontwardly from the lateral faces 30 beyond a respective lateral edge thereof, and a single second section extends frontwardly from the upper face beyond the upper edge of the front end face.

A second folding step 128 follows, where the first sections are each folded around the respective lateral edge and against the one second peripheral face.

Corners of each first section of the wrapper material are then secured to the corresponding second peripheral face proximate to the lower edge in step 130.

Optionally, the grip on the wrapper material is then switched in step 131, wherein the switch between the first and second gripping configurations is done without completely releasing the wrapper material. In a particular embodiment, this is done with gripping units switching from the first to the second gripping configurations described above.

A third folding step 134 is carried out in which each second section is folded downwardly around the respective upper edge and against the respective second peripheral face.

The second section of the wrapper material is then secured over the respective second peripheral face in step 136. Throughout the steps following the grabbing step 122, the wrapper material is continuously retained on at least one fixed location thereon.

The wrapper material is then released in subsequent step 138, and a first portion of the article is wrapped. In some embodiments, wrapping of the article is stopped here, and at least one face of the article in addition to the bottom face is left without wrapping. For example, the above-described method can be used to completely wrap the longitudinal faces 30, upper face 28 and front end face 24, while the rear end face remains free of wrapping.

In a particular embodiment, a relative movement is provided between the article and the wrapper material to position the article for the wrapping of the second portion thereof, and the steps 122, 124, 126, 128, 130, 132, 134, 136 and 138 are repeated for the second portion of the article.

For example, for the wrapping of the second portion of the embodiment of FIGS. 2-11, the at least one peripheral face now corresponds to the rear end face 26, and the upper edge corresponds to the corresponding upper transversal edge 40. The at least one second peripheral face corresponds again to the two lateral faces 30, two first sections each extend laterally from the rear end face beyond a respective lateral edge thereof, and two second section each extend laterally from the upper face beyond the upper edge of the respective lateral face. For the wrapping of the second portion of the embodiment of FIGS. 13-23, the at least one peripheral face still correspond to the two lateral faces 30, and the upper edge corresponds to the respective upper longitudinal edge 38. The at least one second peripheral face corresponds to the rear end face 26, two first sections each extend rearwardly from the lateral faces 30 beyond a respective lateral edge thereof, and a single second section extends rearwardly from the upper face beyond the upper edge of the rear end face.

It is appreciated that several steps can be carried out sequentially, simultaneously or in inverted order comparatively the to the step sequence described above in reference to FIG. 12. Moreover, steps can be added to or removed from the step sequence described above in reference to FIG. 12. The method of FIG. 12 has been correlated with the described embodiments in an exemplary fashion which should not be viewed as limitative.

Generally, the step sequence is designed to first wrap the front end face 24 of the article 22, then to cover the upper face 28 and the lateral faces 30 of the article 22, and finally to wrap the rear end face 26 of the article 22 with the wrapper material 60 being folded and secured to peripheral faces of the article 22. Only one wrapper holder 70 is provided for wrapping both ends faces 24, 26.

It is appreciated that the conveyor 48 can be any suitable type used to move articles such as, without being limitative, roller track, band conveyor, chain conveyor or similar. The conveyor path is adapted to pass through or by a wrapping station of the wrapping apparatus 20. In an embodiment, the wrapper material source, such as the wrapper material roll 50, is disposed above the conveyor path. However, in alternate embodiments, it is appreciated that the wrapper material source can be disposed on either side of or even below the article.

The same wrapper holder 70 is used to grab and folds the wrapper material 60.

The wrapping apparatus 20 provides a simple, reliable and automatic manner for wrapping parallelepiped shaped articles. It can be used for wrapping articles having different widths and/or lengths and/or heights. Once the article is wrapped, the wrapper has a substantially uniform appearance and is tight enough to withstand the stresses caused by various handlings, such as transportation and storage.

The wrapping apparatus and the method can be used to wrap articles having irregular surfaces, concavities in the surfaces or inclined surfaces.

Moreover, the wrapping apparatus 20 can be used to wrap articles of various lengths. The length of the apparatus 20 is relatively short comparatively to prior art apparatus.

Several wrapper materials can be used, for instance and without being limitative, paper, board or plastic sheets, such as for example polyethylene. The wrapper material can be woven or non-woven. It can be made of various material layers. For example and without being limitative, it can be made of a polymer layer laminated on a paperboard layer. If the wrapper material is a polymer layer, it can be stretchable or non-stretchable. The wrapper material can be provided as sheets or from a wrapper material roll. The width of the wrapper material can be adapted to be modified according to the dimensions of the article to be wrapped in the beginning or during the wrapping procedure. The apparatus can include several wrapper rolls and wrapper delivering unit frame, each roll wrapper roll having a different width and the wrapper roll being selected in accordance with the article being wrapped.

The embodiments of the invention described above are intended to be exemplary. Those skilled in the art will therefore appreciate that the foregoing description is illustrative only, and that various alternate configurations and modifications can be devised without departing from the spirit of the present invention. For instance, the wrapper material can be printed on either prior the wrapping step or following the wrapping step. Accordingly, the present invention is intended to embrace all such alternate configurations, modifications and variances which fall within the scope of the appended claims.

The invention claimed is:

1. A method for wrapping at least a portion of an article having a substantially parallelepiped shape or a parallelepiped shape with a wrapper material, the method comprising:

grabbing the wrapper material along at least one first wrapper edge of the wrapper material, proximate to a first end of the wrapper material, wherein grabbing the wrapper material includes clamping the wrapper material with at least two movable gripping units located on opposed sides of the article, each gripping unit including at least first and second wrapper grippers clamping the wrapper material;

extending the wrapper material over at least part of an upper face of the article;

folding the wrapper material to cover at least one first peripheral face of the article with the wrapper material, such that each one of at least two first sections of the wrapper material extends beyond a respective first lateral edge of the at least one first peripheral face and such that each one of at least one second section of the wrapper material extends beyond an upper edge of a respective one of at least one second peripheral face adjacent the at least one first peripheral face;

folding each first section about the respective first lateral edge and against one of the at least one second peripheral face;

securing each folded first section to the one of the at least one second peripheral face;

partially releasing the wrapper material such as to change a gripping configuration thereof by disengaging the first wrapper gripper of each unit from the wrapper material while keeping the second wrapper gripper of each unit clamped on the wrapper material;

folding each second section about the upper edge of the respective second peripheral face and against the respective second peripheral face; and securing each folded second section to the respective second peripheral face;

wherein the wrapper material remains at least partially grabbed until at least one of the at least one second section is secured.

2. The method as claimed in claim 1, wherein the at least on first peripheral face includes a front face and the at least one second peripheral face includes two opposed lateral faces, the article further including a rear face opposed to the front face, the method further comprising:

grabbing the wrapper material along at least one second wrapper edge of the wrapper material, proximate to a second end of the wrapper material opposed to the first end;

folding the wrapper material to cover a rear face of the article with the wrapper material such that each one of two third sections of the wrapper material extends beyond a respective second lateral edge of the rear face and such that each one of two fourth sections of the wrapper material extends beyond an upper edge of a respective one of the two lateral faces;

folding each third section about the respective second lateral edge and against a respective one of the lateral faces;

securing each folded third section to the respective lateral face;

folding each fourth section about the upper edge of the respective lateral face and against the respective lateral face; and securing each folded fourth section to the respective lateral face;

wherein the wrapper material remains at least partially grabbed along the at least one second wrapper edge until at least one of the fourth sections is secured.

3. The method as claimed in claim 1, wherein the at least one first peripheral face includes two opposed lateral faces and the at least one second peripheral face includes a front face, the article further including a rear face opposed to the front face, the method further comprising:

grabbing the wrapper material along at least one second wrapper edge of the wrapper material, proximate to a second end of the wrapper material opposed to the first end, the wrapper material covering the lateral faces of the article such that each one of two third sections of the wrapper material extends beyond a respective second lateral edge of a respective one of the lateral faces and such that a fourth section of the wrapper material extends beyond an upper edge of the rear face;

folding each third section about the respective second lateral edge and against the rear face;

securing each folded third section to the rear face;

folding each fourth section about the upper edge and against the rear face; and securing each folded fourth section to the rear face;

wherein the wrapper material remains at least partially grabbed along the at least one second wrapper edge until the fourth section is secured.

4. The method as claims in claim 2, wherein after securing each folded third section and prior to folding each fourth section, the wrapper material is partially released such as to change a gripping configuration thereof.

5. The method as claimed in claim 1, wherein each folding step is carried out until a respective predetermined target is reached.

6. The method as claimed in claim 5, wherein each predetermined target comprises at least one of a torque or position of wrapper grippers grabbing the wrapper material and a measured stress applied to the wrapper material.

7. The method as claimed in claim 1, further comprising delivering the wrapper material in the form of a web and cutting the web to a desired length after at least some of the folding steps are performed.

8. The method as claimed in claim 1, wherein at least one of the wrapper grippers is controlled independently of at least another one of the wrapper grippers.

9. The method as claimed in claim 1, wherein at least two of the wrapper grippers are controlled simultaneously.

10. The method as claimed in claim 1, wherein the at least two gripping units are movable along the three perpendicular directions.

11. The method as claimed in claim 1, wherein the at least two gripping units are rotatable.

12. The method as claimed in claim 10, wherein each folding step is carried out until a respective predetermined target is reached and wherein the predetermined target comprises at least one of a torque or position of at least one of the mechanical wrapper grippers grabbing the wrapper material and a measured stress applied to the wrapper material.

13. A method for wrapping at least a portion of an article having a substantially parallelepiped shape or a parallelepiped shape with a wrapper material, the method comprising:

grabbing the wrapper material along at least one first wrapper edge of the wrapper material, proximate to a first end of the wrapper material with at least one mechanical wrapper gripper;

extending the wrapper material over at least part of an upper face of the article;

folding the wrapper material to cover at least one first peripheral face of the article with the wrapper material, such that each one of at least two first sections of the wrapper material extends beyond a respective first lateral edge of the at least one first peripheral face and such that each one of at least one second section of the wrapper material extends beyond an upper edge of a respective one of at least one second peripheral face adjacent the at least one first peripheral face;

folding each first section about the respective first lateral edge and against one of the at least one second peripheral face;

securing each folded first section to the one of the at least one second peripheral face;

folding each second section about the upper edge of the respective second peripheral face and against the respective second peripheral face; and securing each folded second section to the respective second peripheral face;

wherein the wrapper material remains at least partially grabbed until at least one of the at least one second section is secured and wherein each folding step is carried out until a respective predetermined target is reached and wherein the predetermined target comprises at least one of a torque or position of the at least one mechanical wrapper gripper grabbing the wrapper material and a measured stress applied to the wrapper material.

* * * * *